US010710361B2

(12) United States Patent
Misumi et al.

(10) Patent No.: US 10,710,361 B2
(45) Date of Patent: Jul. 14, 2020

(54) LIQUID DISCHARGE HEAD SUBSTRATE, LIQUID DISCHARGE HEAD, LIQUID DISCHARGE APPARATUS, AND METHOD OF CONTROLLING LIQUID DISCHARGE HEAD

(71) Applicant: CANON KABUSHIKI KAISHA, Tokyo (JP)

(72) Inventors: Yoshinori Misumi, Tokyo (JP); Maki Kato, Fuchu (JP); Yuzuru Ishida, Yokohama (JP); Tsubasa Funabashi, Kawasaki (JP); Takahiro Matsui, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/105,314

(22) Filed: Aug. 20, 2018

(65) Prior Publication Data

US 2019/0061343 A1 Feb. 28, 2019

(30) Foreign Application Priority Data

Aug. 22, 2017 (JP) ..... 2017-159810

(51) Int. Cl.
*B41J 2/045* (2006.01)
*B41J 2/14* (2006.01)
*B41J 2/21* (2006.01)

(52) U.S. Cl.
CPC ..... *B41J 2/04541* (2013.01); *B41J 2/0458* (2013.01); *B41J 2/1404* (2013.01); *B41J 2/14024* (2013.01); *B41J 2/14072* (2013.01); *B41J 2/14096* (2013.01); *B41J 2/14129* (2013.01); *B41J 2/2103* (2013.01); *B41J 2202/12* (2013.01)

(58) Field of Classification Search
CPC . B41J 2/04541; B41J 2/06; B41J 29/38; B41J 2/1404; B41J 2/14129; B41J 2/14072; B41J 2202/12; B41J 2/0458; B41J 2/14; B41J 2/14024; B41J 2/14096; B41J 2/18; B41J 2/2103
See application file for complete search history.

(56) References Cited

U.S. PATENT DOCUMENTS

| | | | | |
|---|---|---|---|---|
| 8,210,654 | B2 | 7/2012 | Wei et al. | |
| 2003/0058307 | A1 | 3/2003 | Eguchi | |
| 2005/0151795 | A1* | 7/2005 | Furukawa | B41J 2/06 347/52 |

(Continued)

*Primary Examiner* — Jannelle M Lebron
(74) *Attorney, Agent, or Firm* — Canon U.S.A. Inc., IP Division

(57) ABSTRACT

A liquid discharge head substrate including a discharge opening through which a liquid is discharged, a base that includes a surface in which a heat generating element that generates heat to discharge the liquid through the discharge opening is provided, a first electrode that covers the heat generating element, a flow passage through which the liquid flows from a supply port that supplies the liquid, through the surface of the first electrode, and towards a collection port that collects the liquid, and a second electrode provided inside the flow passage, the second electrode together with the first electrode forming an electric field in the liquid, in which the second electrode is provided downstream of the first electrode in a flow direction of the liquid flowing towards the collection port from the supply port.

17 Claims, 17 Drawing Sheets

(56) References Cited

U.S. PATENT DOCUMENTS

| | | | | |
|---|---|---|---|---|
| 2011/0205303 | A1 | 8/2011 | Pan | |
| 2016/0001560 | A1 | 1/2016 | Yoshinari | |
| 2016/0193837 | A1 | 7/2016 | Kudo | |
| 2017/0173953 | A1 | 6/2017 | Taniguchi | |
| 2017/0197419 | A1* | 7/2017 | Okushima | B41J 2/18 |

* cited by examiner

LIQUID DISCHARGE HEAD SUBSTRATE, LIQUID DISCHARGE HEAD, LIQUID DISCHARGE APPARATUS, AND METHOD OF CONTROLLING LIQUID DISCHARGE HEAD

BACKGROUND OF THE INVENTION

Field of the Invention

The present disclosure relates to a liquid discharge head substrate that discharges a liquid, a liquid discharge head, a liquid discharge apparatus, and a method of controlling a liquid discharge head.

Description of the Related Art

At present, many liquid discharge apparatuses are employed that discharge a droplet from a discharge opening with bubble generating energy created by film boiling a liquid by applying electricity to a heat generating element and heating the liquid inside a liquid chamber.

In such a liquid discharge apparatus, there are cases in which a physical effect, such as an impact caused by cavitation that occurs when liquid bubbling, shrinkage, and debubbling takes place, is exerted on an area in a heat generating element. Furthermore, when a discharge of the liquid is performed, since the heat generating element is at a high temperature, there are cases in which chemical action, such as adhesion, solidification and accumulation of thermally decomposed component of the liquid, is exerted on an area in the heat generating element. In order to protect the heat generating element from such physical effect and chemical action, a protective layer formed of a metal material and the like that covers the heat generating element is disposed.

Among the protective layers on the heat generating element, in a heat applying portion that comes in contact with the liquid, there is a phenomenon in which the color material and the additive contained in the liquid being heated at high temperature becomes decomposed at a molecular level and changes into a substance with low solubility and becomes physically absorbed on the heat applying portion. The above phenomenon is referred to as "kogation". As described above, when an organic material or an inorganic material with low solubility becomes absorbed into the heat applying portion of the protective layer, the thermal conduction from the heat applying portion to the liquid becomes uniform and the bubbling becomes unstable.

As a measure to counter such kogation, U.S. Pat. No. 8,210,654 discloses a method to suppress generation of kogation. Specifically, in U.S. Pat. No. 8,210,654, a second electrode separate from a first electrode including a heat applying portion is provided inside a liquid chamber, and a voltage is applied between the two electrodes to form an electric field in the liquid inside the liquid chamber so that the charged colloidal particles is kept away from the heat applying portion.

However, in recent years, there is a need for a liquid discharge apparatus with high durability, and there is a need to suppress the generation of kogation even more. In particular, demands are rising for liquid discharge apparatuses used in offices and liquid discharge apparatuses for commercial printing that have higher durability and longer life.

SUMMARY OF THE INVENTION

The present disclosure provides a liquid discharge head substrate capable of further suppressing generation of kogation and improve durability of the liquid discharge head substrate.

A liquid discharge head substrate of the present disclosure includes a discharge opening through which a liquid is discharged, a base that includes a surface in which a heat generating element that generates heat to discharge the liquid through the discharge opening is provided, a first electrode that covers the heat generating element, a flow passage through which the liquid flows from a supply port that supplies the liquid, through the surface of the first electrode, and towards a collection port that collects the liquid, and a second electrode provided inside the flow passage, the second electrode together with the first electrode forming an electric field in the liquid, in which the second electrode is provided downstream of the first electrode in a flow direction of the liquid flowing towards the collection port from the supply port.

The present disclosure is capable of further suppressing generation of kogation in a liquid discharge head substrate and is capable of improving a durability of the liquid discharge head substrate.

Further features will become apparent from the following description of exemplary embodiments with reference to the attached drawings.

DESCRIPTION OF THE EMBODIMENTS

Hereinafter, exemplary embodiments of the present disclosure will be described with reference to the drawings. Note that the following description does not limit the scope of the present disclosure.

While the present exemplary embodiments are ink jet printers (printers) configured to circulate a liquid, such as ink, between a tank and a liquid discharge apparatus, the present exemplary embodiments may have different configurations. For example, the present exemplary embodiments may have a configuration in which the ink inside the pressure chamber is distributed without any circulation of the ink by providing two tanks on the upstream side and the downstream side of the liquid discharge apparatus and distributing the ink from one tank to the other.

Furthermore, while the present exemplary embodiment is a liquid discharge apparatus having a so-called line head that has a length corresponding to the width of the printed medium, the present disclosure can be applied to a so-called serial-type liquid discharge apparatus that performs printing while scanning the printed medium. The serial-type liquid discharge apparatus may have a configuration in which a single printing element substrate for black ink and a single printing element substrate for chromatic color ink are mounted, for example. Not limited to the above, a short line head that has a length shorter than the width of the printed medium and that includes a plurality of printing element substrates disposed in a discharge opening column direction so as to overlap the discharge opening may be fabricated, and the short line head may be configured to scan the printed medium.

First Exemplary Embodiment

Ink Jet Printer

Figure 1:
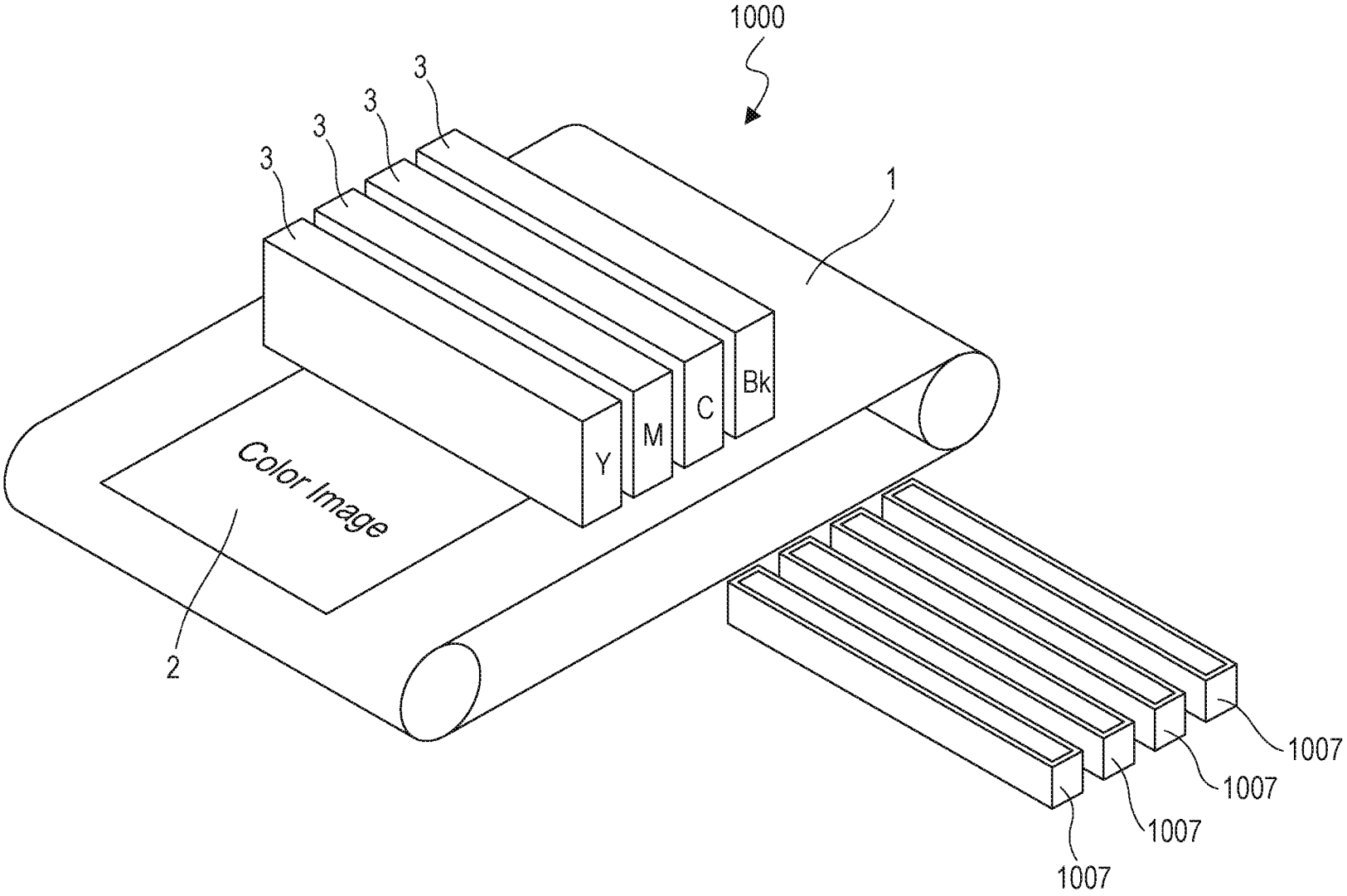
FIG. 1 is a schematic block diagram of a printer.

A schematic configuration of a liquid discharge apparatus of the present exemplary embodiment, in particular, an ink jet printer 1000 (hereinafter, also referred to as a printer) that performs printing by discharging ink is illustrated in FIG. 1. The printer 1000 is a line printer that includes a conveying unit 1 that conveys a printed medium 2, and line-type liquid discharge heads 3 disposed substantially orthogonal to a conveying direction of the printed medium, and that performs continuous printing with a single pass while continuously or intermittently conveying a plurality of printed mediums 2. The printed medium 2 is not limited to a cut sheet and maybe a continuous roll sheet. The printer 1000 includes four liquid discharge heads 3 each for a single color corresponding to one of inks I of four colors, namely, CMYK (cyan, magenta, yellow, black). Furthermore, the printer 1000 includes caps 1007. By covering the surfaces of the liquid discharge heads 3 on the discharge opening side with the caps 1007 when printing is not performed, evaporation of the inks through the discharge openings can be prevented.

First Circulation Path

Figure 2:
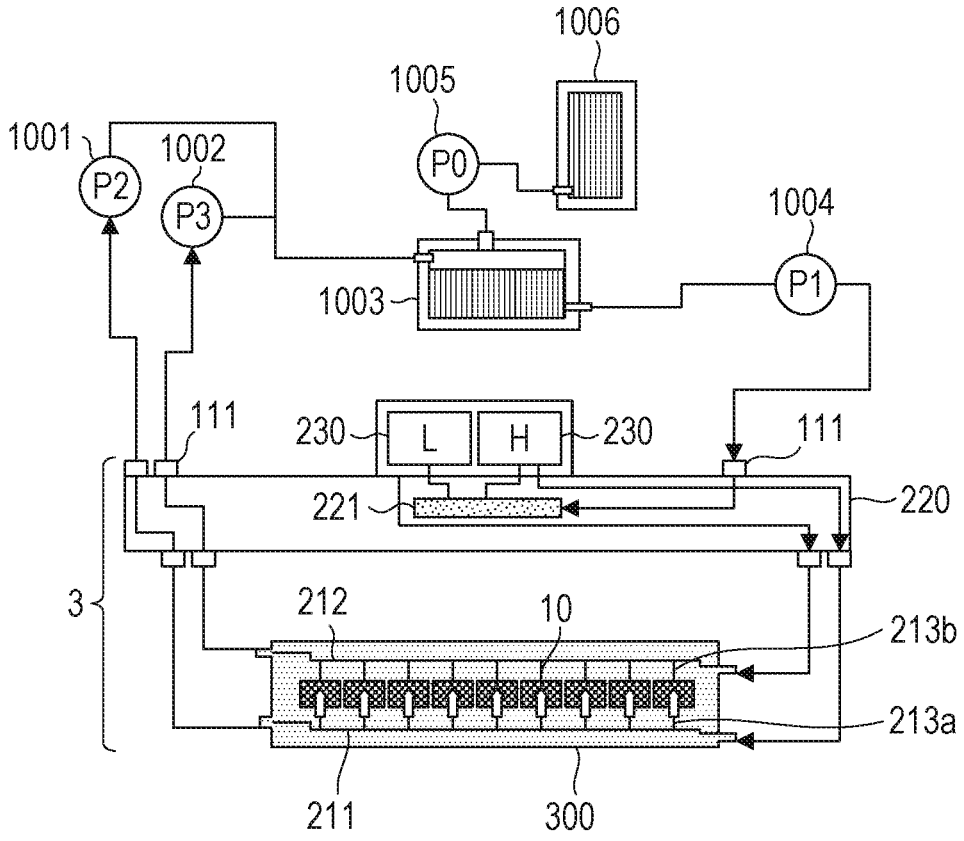
FIG. 2 is a schematic diagram illustrating a first circulation path.

FIG. 2 is a schematic diagram illustrating a first circulation path that is a form of a circulation path used in the printer of the present exemplary embodiment. FIG. 2 is a diagram illustrating a fluid connection between a liquid discharge head 3, a first circulation pump (a high pressure side) 1001, a first circulation pump (a low pressure side) 1002, a buffer tank 1003, and the like. Note that in FIG. 2, in order to simplify the description, only a single path through which an ink among the CMYK inks flows is illustrated; however, circulation paths for four colors are provided in a main body of the printer. The buffer tank 1003 serving as a sub tank connected to the main tank 1006 includes an air communication port (not shown) that connects the inside and the outside of the tank to each other, and is capable of discharging the bubble inside the ink to the outside. The buffer tank 1003 is also connected to a replenishing pump 1005. The replenishing pump 1005 transfers the ink from the main tank 1006 to the buffer tank 1003 amounting to the amount consumed when the ink is consumed in the liquid discharge head 3 by discharge of the ink through a discharge opening of the liquid discharge head when printing, a suction recovery, or the like by discharging ink is performed.

The two first circulation pumps 1001 and 1002 have a role of drawing out the ink through connecting portions 111 of the liquid discharge head 3 and distributing the ink to the buffer tank 1003. The first circulation pumps are desirably displacement pumps that are capable of quantitative distribution of the ink. Specifically, the first circulation pumps each include a tube pump, a gear pump, a diaphragm pump, a syringe pump, or the like; however, a configuration in which a constant flow rate is obtained by disposing a typical constant flow valve or relief valve at the pump outlet may be used, for example. When the liquid discharge head 3 is driven, a fixed amount of ink flows inside a common supply passages 211 and a common collecting passages 212 with the first circulation pump (the high pressure side) 1001 and the first circulation pump (the low pressure side) 1002. The above flow rate is desirably set to a rate or to a rate higher than a rate in which the temperature difference between printing element substrates 10 in the liquid discharge head 3 becomes a temperature difference that does not affect the image quality. Note that when the flow rate is set to an excessively high rate, due to the effect of the pressure drop in a flow passage inside a discharge unit 300, the negative pressure differences in the printing element substrates 10 become too large and unevenness in the density of the image occurs. Accordingly, the flow rate is, desirably, set while taking the temperature difference between the printing element substrates 10 and the negative pressure difference into consideration.

Negative pressure control units 230 are provided in paths between a second circulation pump 1004 and the discharge unit 300. The negative pressure control units 230 are functioned to operate so that the pressure downstream (that is, the discharge unit 300 side) of the negative pressure control units 230 are maintained at a fixed pressure set in advance even when the flow rate of the circulation system changes due to the change in printing duty. Two pressure controlling mechanisms constituting the negative pressure control units 230 may be any mechanism that is capable of controlling the pressure downstream thereof to be within a fixed fluctuation range with respect to a desired set pressure. For example, a mechanism similar to a so-called "pressure-reducing regulator" may be employed. In a case in which a pressure-reducing regulator is used, as illustrated in FIG. 2, it is desirable that the upstream side of each negative pressure control unit 230 is pressurized with the second circulation pump 1004 through supply units 220. By so doing, the influence of the water head pressure between the buffer tank 1003 and the liquid discharge head 3 to the liquid discharge head 3 can be suppressed, and the degree of freedom in the layout of the buffer tank 1003 in the printer 1000 can be increased. The second circulation pump 1004 may be any pump that is, in the range of the circulation flow rate of the ink used when the liquid discharge head 3 is driven, capable of having a pump head pressure that is equivalent to or higher than a fixed pressure, and a turbo pump, a displacement pump, or the like may be used. Specifically, a diaphragm pump or the like can be used. Furthermore, in place of the second circulation pump 1004, for example, a water header tank disposed so as to have a fixed water head difference with the negative pressure control units 230 can be used.

As illustrated in FIG. 2, the negative pressure control units 230 include the two pressure controlling mechanisms set with different control pressures. Between the two negative pressure controlling mechanisms, the side set with a relatively high pressure (denoted as H in FIG. 2) and the side set with a relatively low pressure (denoted as L in FIG. 2) are connected to the common supply passages 211 and the common collecting passages 212 inside the discharge unit 300 through the supply units 220. The discharge unit 300 includes the common supply passages 211, the common collecting passages 212, and individual supply passages 213*a* and individual collecting passages 213*b* that communicate with the printing element substrates 10. Since the individual passages 213 are in communication with the common supply passages 211 and the common collecting passages 212, flows (arrows in FIG. 2) in which a portion of the ink flows from the common supply passages 211 to the common collecting passages 212 while passing through the inner flow passages of the printing element substrates 10 are generated. The above is generated due to a pressure difference created between the two common flow passages with the pressure controlling mechanism H connected to the common supply passages 211 and the pressure controlling mechanism L connected to the common collecting passages 212.

In the discharge unit 300, while the ink is distributed so as to pass through the common supply passages 211 and the common collecting passages 212, flows are generated so that a portion of the ink passes through the printing element substrates 10 in the above manner. Accordingly, the heat generated in the printing element substrates 10 can be discharged to the outside of the printing element substrates 10 with the flow in the common supply passages 211 and the common collecting passages 212. Furthermore, with such a configuration, since the flow of ink can be created in the discharge openings and the pressure chambers that are not performing printing while printing is performed with the liquid discharge heads 3, thickening of the ink in the above areas can be suppressed. Furthermore, ink that has become thickened and foreign substances in the ink can be discharged to the common collecting passages 212. Accordingly, the liquid discharge heads 3 of the present exemplary embodiment can perform high speed and high quality printing.

Second Circulation Path

Figure 3:
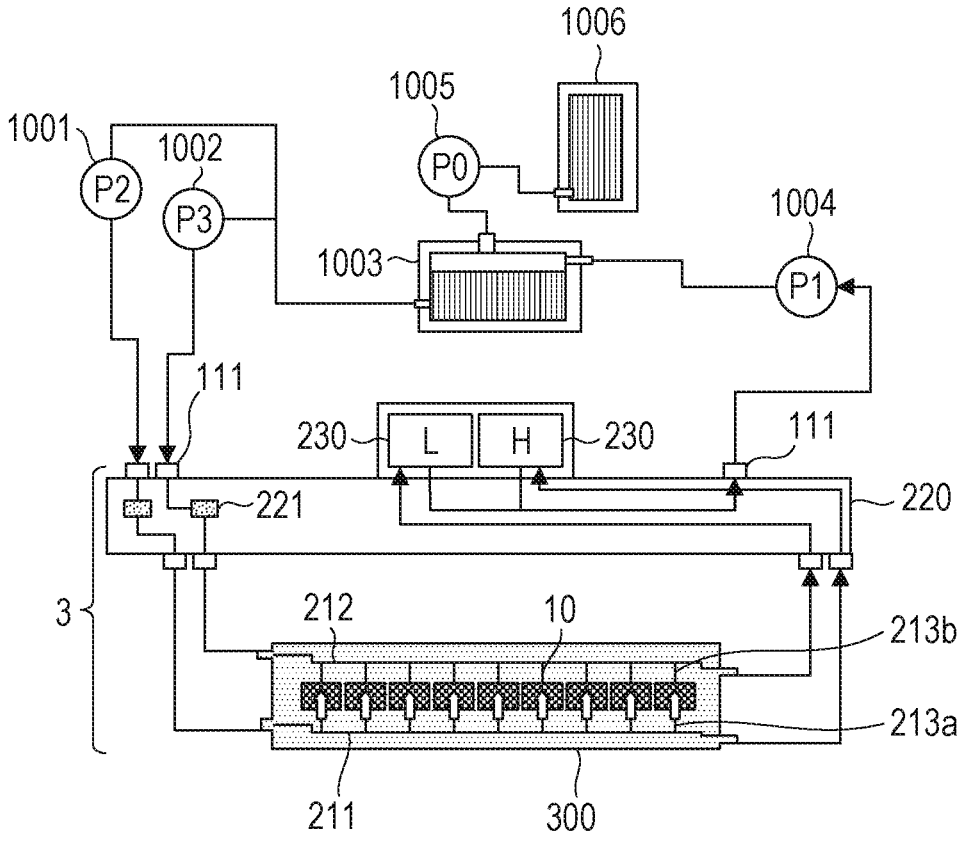
FIG. 3 is a schematic diagram illustrating a second circulation path.

FIG. 3 is a schematic diagram illustrating a second circulation path that s a form of circulation that is different from the first circulation path described above, among the circulation paths used in the printer 1000 of the present exemplary embodiment. The main point different from the first circulation path described above is that the two pressure controlling mechanisms constituting the negative pressure control units 230 are both mechanisms that control the pressure upstream the negative pressure control units 230 to be within a fixed fluctuation range with respect to a desired set pressure. The two pressure controlling mechanisms are mechanism components that have the same function as a so-called. "back pressure regulator". Furthermore, another point that is different is that the second circulation pump 1004 functions as a negative pressure source that reduces the pressure downstream of the negative pressure control units 230. Furthermore, yet another point that is different is that the first circulation pump (the high pressure side) 1001 and the first circulation pump (the low pressure side) 1002 are disposed upstream of the liquid discharge head 3, and the negative pressure control units 230 are disposed downstream of the liquid discharge head 3.

Even when there is a change in the flow rate due to a change in the printing duty when printing with the liquid discharge head 3, the negative pressure control units 230 operate so that the pressure fluctuation on the upstream (that is, the discharge unit 300) side thereof is stabilized in a fixed area with respect to a pressure set in advance. As illustrated in FIG. 3, it is desirable that the downstream side of the negative pressure control units 230 is pressurized with the second circulation pump 1004 through the supply units 220. By so doing, the influence of the water head pressure between the buffer tank 1003 and the liquid discharge head 3 to the liquid discharge head 3 can be suppressed, and the choice in the layout of the buffer tank 1003 in the printer 1000 can be increased. In place of the second circulation pump 1004, for example, a water header tank disposed so as to have a predetermined water head difference with the negative pressure control units 230 can be used.

Similar to the first circulation path, as illustrated in FIG. 3, the negative pressure control units 230 include two pressure controlling mechanisms set with different control pressures. Between the two negative pressure controlling mechanisms, the side set with a high pressure (denoted as H in FIG. 3) and the side set with a low pressure (denoted as L in FIG. 3) are connected to the common supply passages 211 and the common collecting passages 212 inside the liquid discharge unit 300 through the supply units 220. The pressure in the common supply passages 211 is made relatively higher than the pressure in the common collecting passages 212 with the two negative pressure controlling mechanisms. With the above, flows of ink flowing from the common supply passages 211 to the common collecting passages 212 through the individual passages 213 and the inner flow passages of the printing element substrates 10 are generated (arrows in FIG. 3). As described above, in the second circulation path, an ink flowing state similar to that of the first circulation path is obtained in the discharge unit 300. The second circulation path has two advantages that are different from those of the first circulation path.

The first advantage is that since in the second circulation path, the negative pressure control units 230 are disposed downstream of the liquid discharge head 3, there is little concern that waste and foreign substances generated in the negative pressure control units 230 will flow into the head. The second advantage is that in the second circulation path, the maximum value of the flow rate needed to be supplied from the buffer tank 1003 to the liquid discharge head 3 is smaller than that of the first circulation path. The reason for the above is as follows. The sum of the flowrates inside the common supply passages 211 and the common collecting passages 212 when the ink is circulated during the print standby period is denoted as A. The value of A is defined as the minimum flow rate needed to set the temperature difference in the liquid discharge unit 300 within a desired range when temperature adjustment of the liquid discharge head 3 is performed during the print standby. Furthermore, a discharge flow rate of a case in which the ink is discharged from all of the discharge openings of the liquid discharge unit 300 (during full discharge) is defined as F. In such a case, in the first circulation path (FIG. 2), since the set flow rate of the first circulation pump (high pressure side) 1001 and the first circulation pump (low pressure side) 1002 are A, the maximum value of the amount of ink needed to be supplied to the liquid discharge head 3 during full discharge is A+F.

On the other hand, in the case of the second circulation path. (FIG. 3), the amount of ink need to be supplied to the liquid discharge head 3 during the print standby period is flow rate A. Furthermore, the amount needed to be supplied to the liquid discharge head 3 during full discharge is flow rate F. Accordingly, in the case of the second circulation path, the total value of the set flow rates of the first circulation pump (the high pressure side) 1001 and the first circulation pump (the low pressure side) 1002 is, in other words, the maximum value of the flow rate needed to be supplied is the larger value between A and F. Accordingly, as long as the discharge units 300 with the same configuration are used, the maximum value (A or F) of the amount needed to be supplied in the second circulation path is always smaller than the maximum value (A+F) of the flow rate needed to be supplied in the first circulation path. Accordingly, in the case of the second circulation path, the degree of freedom of the circulation pump that can be used is increased and, for example, an inexpensive circulation pump with a simple configuration can be used or a load of a cooler (not shown) installed in the path on the main body side can be reduced. With the above, there is an advantage in that the cost of the main body of the printer can be reduced. The above advantage becomes larger in line head liquid discharge apparatuses in which the value of A or F becomes relatively large, and among the line head liquid discharge apparatuses, line head liquid discharge apparatuses that have a longer length in the longitudinal direction are more advantageous.

However, on the other hand, there is a point in which the first circulation path is more advantageous than the second circulation path. In other words, in the second circulation path, since the flow rate flowing inside the discharge unit 300 is the largest during the print standby period, a state is reached in which the negative pressure applied to the nozzles becomes higher as the printing duty of the image becomes smaller. Accordingly, in a case in particular in which the head width (a length of the liquid discharge head in the transverse direction) is reduced by reducing the flow passage width (a length in a direction orthogonal to the ink flowing direction) of the common supply passages 211 and the common collecting passages 212, a high negative pressure is applied to the nozzles in cases of low duty images in which unevenness is easy to spot. With the above, the satellite droplets may have a large effect. On the other hand, in a case of the first circulation path, since a high negative pressure is applied to the nozzles during formation of high duty images, there is an advantage in that even if a satellite droplet is generated, the droplet is not easily recognized visually, and the effect on the image is small. Regarding the selection between the two circulation path, a preferable choice can be made by referring to the specifications (the discharge flow rate F, the minimum circulation flow rate A, and the flow passage resistance in the head) of the liquid discharge heads and the main body of the printer.

Liquid Discharge Head

Figure 4A:
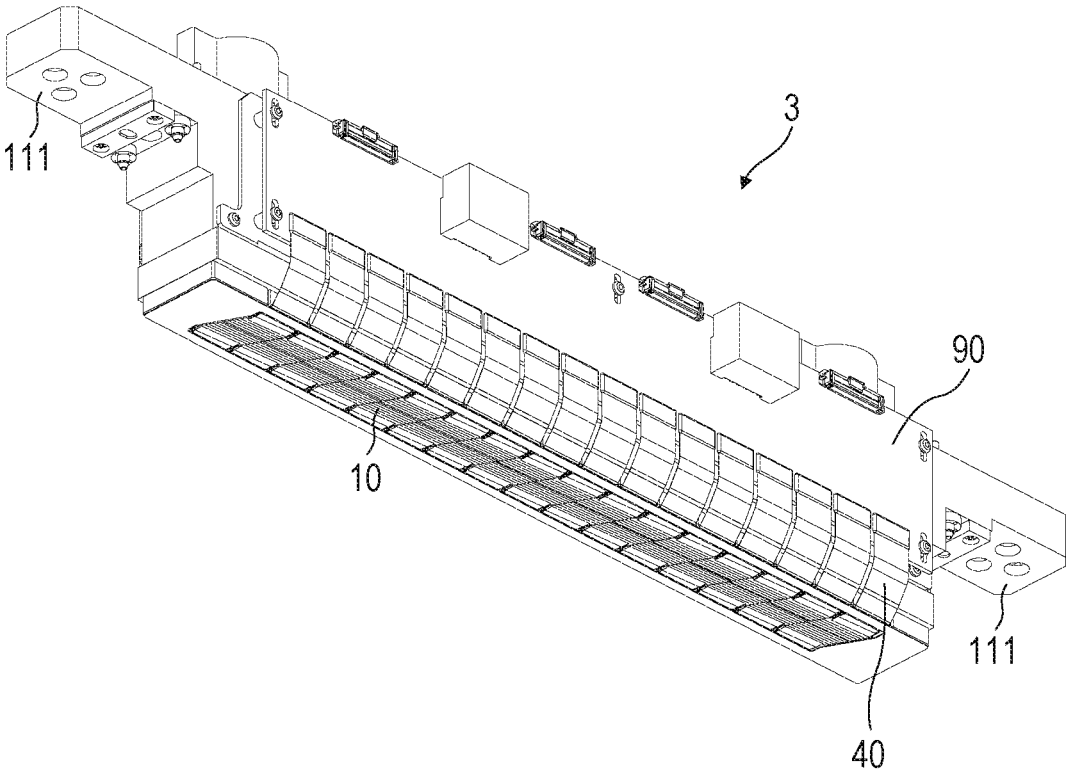
FIGS. 4A are 4B are perspective views of a liquid discharge head.
Figure 4B:
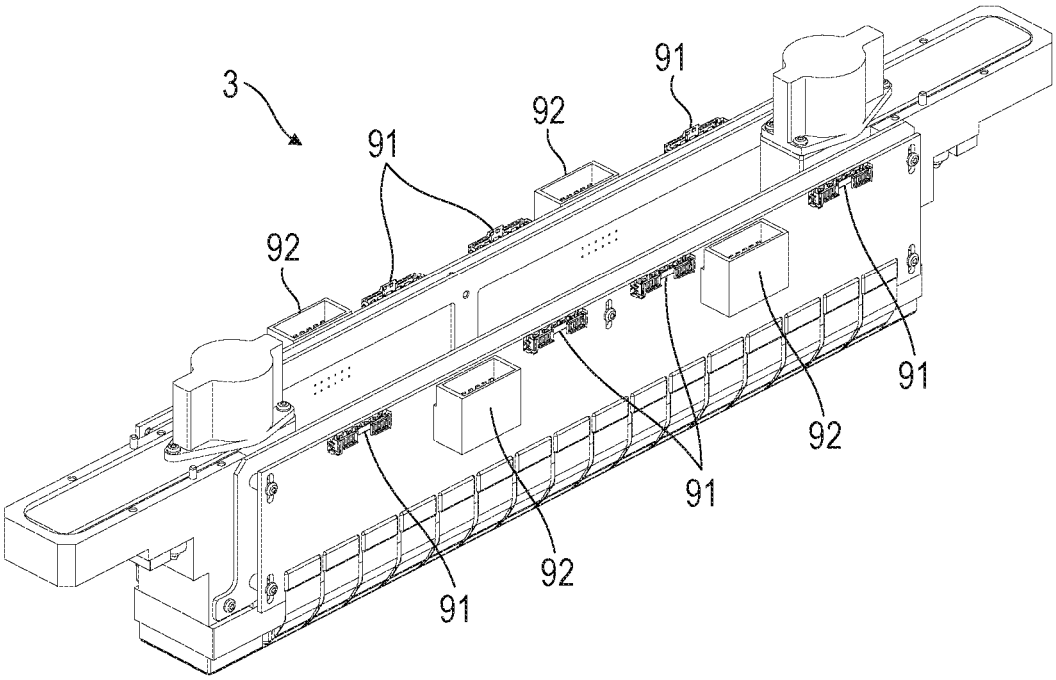

A configuration of the liquid ejection head 3 according to the first exemplary embodiment will be described. FIGS. 4A and 4B are perspective views of the liquid ejection head 3 according to the present exemplary embodiment. The liquid discharge head 3 is a line-type liquid discharge head in which 16 printing element substrates 10, a single printing element substrate 10 being capable of discharging ink of a single color, are aligned on a straight line (disposed inline). The liquid discharge heads 3 that discharge each of the colors of ink are configured in a similar manner.

As illustrated in FIG. 4A, the liquid discharge head 3 includes the printing element substrates 10, flexible wiring substrates 40, and electric wiring substrates 90 provided with signal input terminals 91 and electric power supply terminals 92. The signal input terminals 91 and the electric power supply terminals 92 are electrically connected to the control portion of the printer 1000 and supply a discharge drive signal and electric power needed for the discharge to the printing element substrates 10. By integrating the wiring with the electric circuits in the electric wiring substrates 90, the number of signal input terminals 91 and the number of electric power supply terminals 92 can be less than the number of printing element substrates 10. With the above, the number of electric connection portions needed to be dismounted can be small when the liquid discharge head 3 is installed in the printer 1000 or when the liquid discharge head is replaced. The connecting portions 111 provided on both end portions of the liquid discharge head 3 are connected to an ink supply system of the printer 1000. Ink is supplied to the liquid discharge head 3 through one of the connecting portions 111 from a supply system of the printer 1000, and the ink that has passed inside the liquid discharge head 3 is collected by the supply system of the printer 1000 through the other connecting portion 111. As described above, the liquid discharge head 3 is configured so that the ink can be circulated through the path of the printer 1000 and the path of the liquid discharge head 3.

Figure 5:
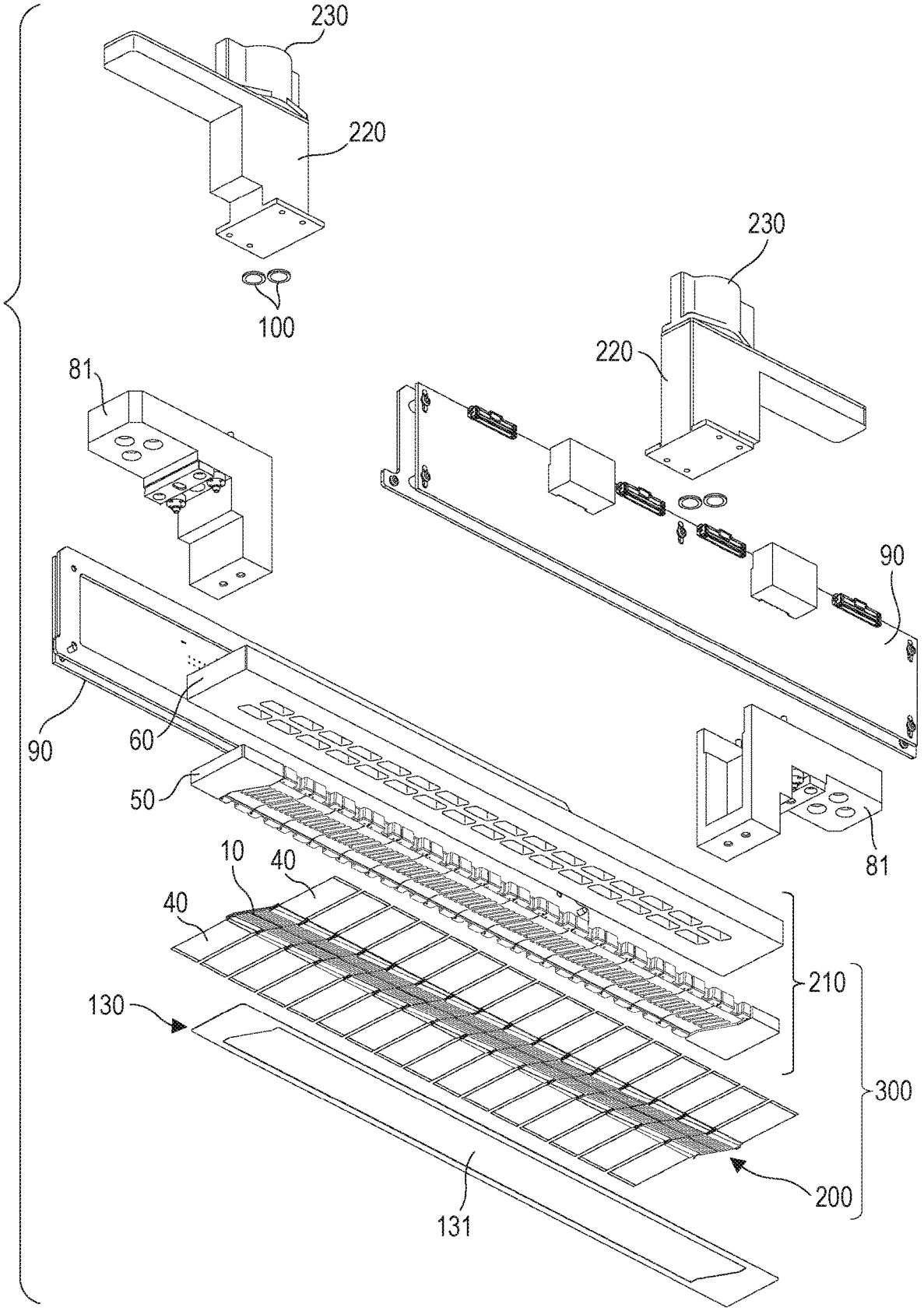
FIG. 5 is an exploded perspective view of the liquid discharge head.

FIG. 5 illustrates an exploded perspective view of the components or the units constituting the liquid discharge head 3. The liquid discharge head 3 includes the discharge unit 300, the supply units 220, the electric wiring substrates 90, and discharge unit support portions 81.

In the liquid discharge head 3 of the present exemplary embodiment, the rigidity of the liquid discharge head 3 is secured by a second flow passage member 60 included in the discharge unit 300. The discharge unit support portions 81 according to the present exemplary embodiment are connected to both end portions of the second flow passage member 60, and the discharge unit 300 are mechanically joined to a carriage of the printer 1000 to perform positioning of the liquid discharge head 3. The supply units 220 provided with the negative pressure control units 230 and the electric wiring substrates 90 are joined to the discharge unit support portions 81. Filters (FIGS. 2 and 3) are built in the two supply units 220. The two negative pressure control units 230 are set to control the pressure with relatively high and low negative pressures that are different from each other. Furthermore, as illustrated in the diagrams, when a high pressure side and a low pressure side negative pressure control units 230 are installed in the liquid discharge head 3, the flows of ink in the common supply passages 211 and the common collecting passages 212 extending in the longitudinal direction of the liquid discharge head 3 oppose each other. With the above, exchange of heat between the common supply passages 211 and the common collecting passages 212 is facilitated and the temperature difference between the two common flow passages is decreased; accordingly, temperature differences in the printing element substrates 10 provided in a plural number along the common flow passages do not occur easily and print unevenness caused by the temperature difference does not occur easily.

The discharge unit 300 includes a plurality of discharge modules 200 and a flow passage member 210, and a cover member 130 is attached to a surface of the discharge unit 300 on the printed medium side. As illustrated in FIG. 5, the cover member 130 is a member having a frame-like shape provided with a long opening 131. The printing element substrates 10 and sealing members 110 (FIG. 9A) included in the discharge modules 200 are exposed from the opening 131. A frame portion at a peripheral of the opening 131 is an abutting surface that abuts against the cap 1007 (FIG. 1) that caps the liquid discharge head 3 during the print standby period. Accordingly, it is desirable that a closed space is formed on the inner side of the cap 1007 in a state in which the liquid discharge head 3 is capped by applying an adhesive, a sealing material, a filling material, and the like along the peripheral of the opening 131 and filing the unevenness and the gap on the discharge opening surface side of the discharge unit 300.

Details of the flow passage member 210 of the discharge unit 300 will be described next. The flow passage member 210 is a member in which first flow passage members 50 and the second flow passage member 60 are stacked, and distributes the ink supplied from the supply units 220 to the discharge module 200. Furthermore, the flow passage member 210 functions as a flow passage member for returning the ink flowing back from the discharge module 200 to the supply units 220. The second flow passage member 60 of the flow passage member 210 is a flow passage member in which the common supply passages 211 and the common collecting passages 212 are formed and has a function of mainly providing a rigidity to the liquid discharge head 3. Accordingly, the material of the second flow passage member 60 is desirably a material that has a sufficient anti-corrosion characteristic to ink and that has high mechanical strength. Specifically, SUS, Ti, alumina, or the like can be used favorably.

Figure 6A:
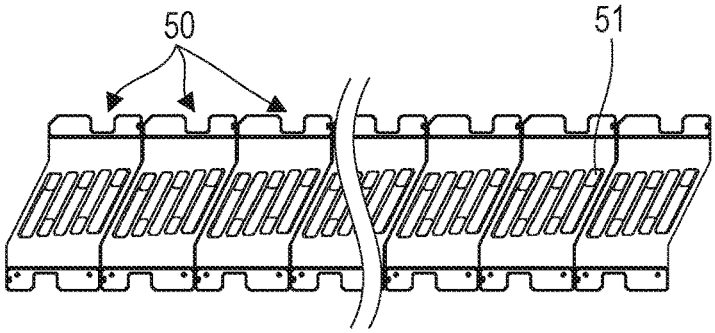
FIGS. 6A to 6E are diagrams illustrating a flow passage member.
Figure 6B:
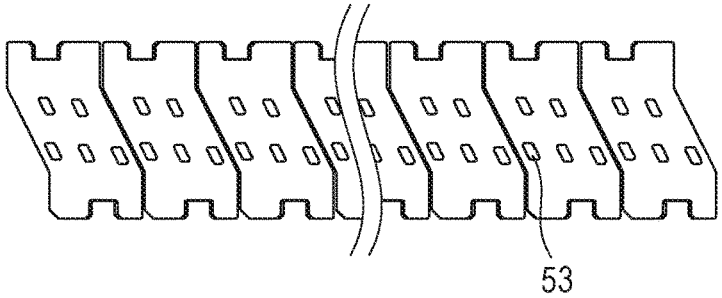
Figure 6C:
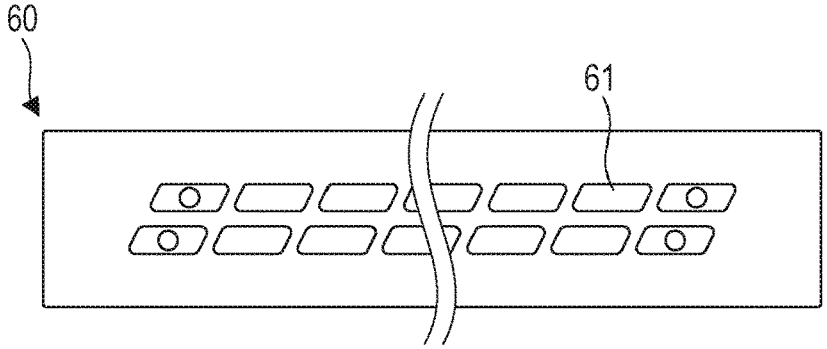
Figure 6D:
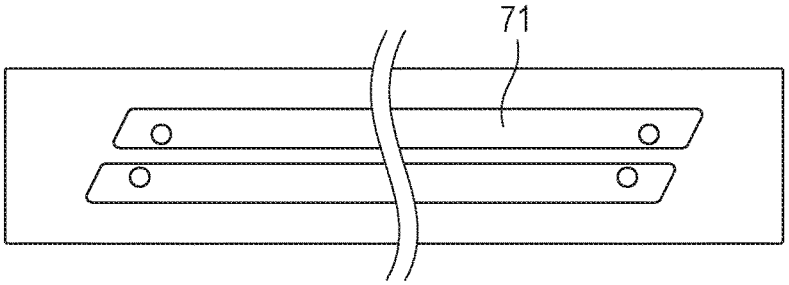
Figure 6E:
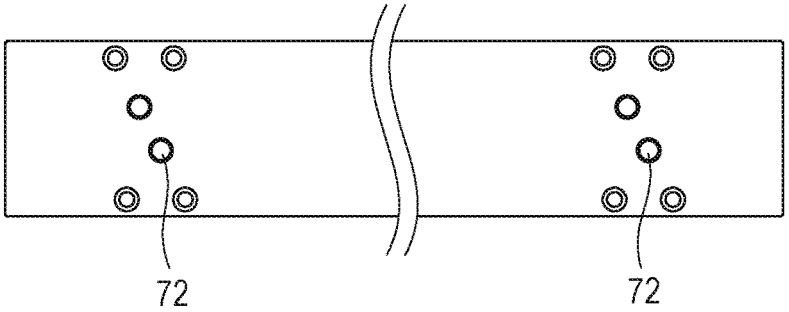

FIG. 6A illustrates surfaces of the first flow passage members 50 on which the discharge module 200 is mounted, and FIG. 6B is a diagram illustrating back surfaces of the first flow passage members 50, which are surfaces against which the second flow passage member 60 abuts. The first flow passage members 50 are provided so as to correspond to each discharge module 200, and a plurality of first flow passage members 50 are arranged. By adopting such a split structure, and by arranging a plurality of modules, the first flow passage member 50 can correspond to the length of the liquid discharge head; accordingly, the first flow passage member 50 can be suitably used particularly in a relatively long liquid discharge head that corresponds to a B2 size or a larger size, for example. As illustrated in FIG. 6A, the communication ports 51 of the first flow passage members 50 are in fluid communication with the discharge module 200 and, as illustrated in FIG. 6B, individual communication ports 53 of the first flow passage members 50 are in fluid communication with communication ports 61 of the second flow passage member 60. FIG. 6C is a diagram illustrating a surface of the second flow passage member 60 on the side against which the first flow passage members 50 abut, FIG. 6D is a diagram illustrating a cross section of a middle portion of the second flow passage member 60 in the thickness direction, and FIG. 6E is a diagram illustrating a surface of the second flow passage member 60 on the side that abuts against the supply units 220.

Figure 8:
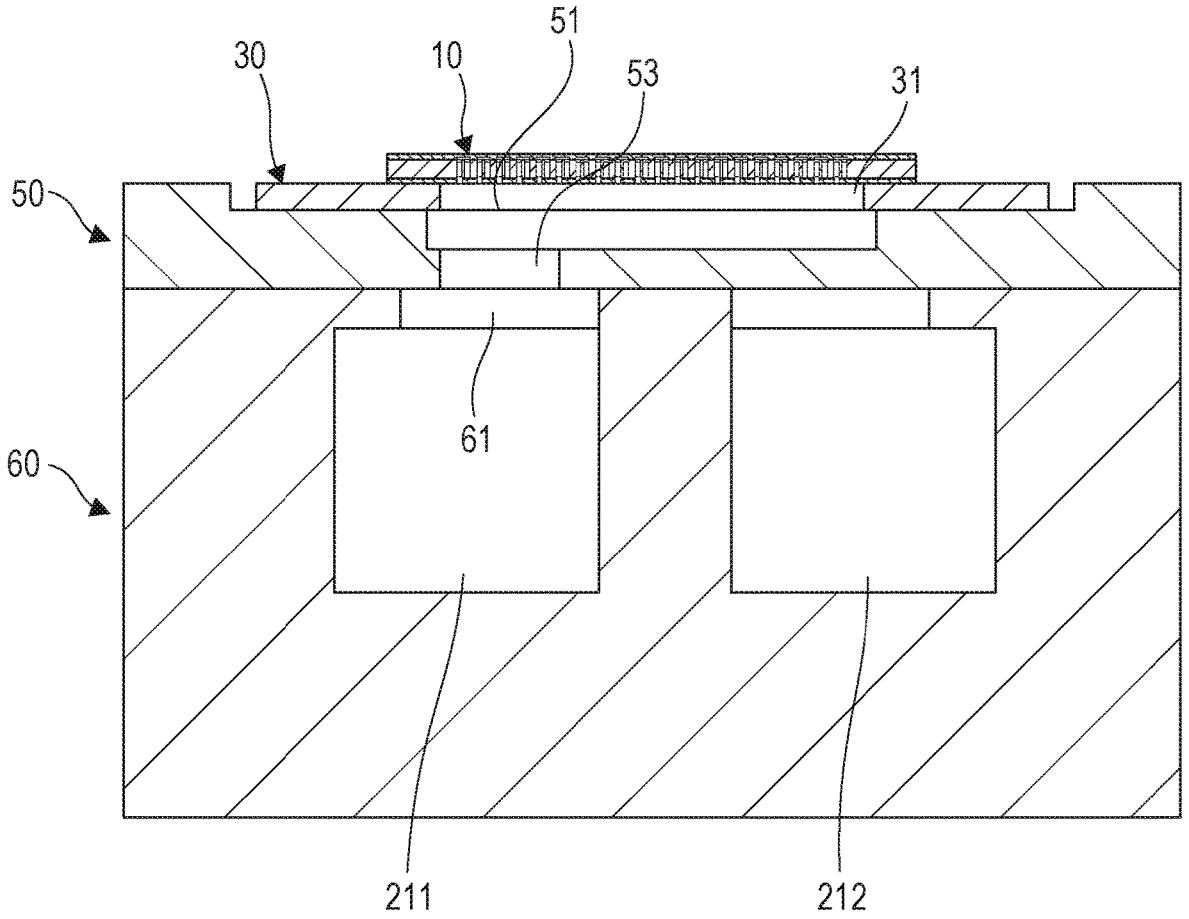
FIG. 8 is a diagram illustrating a cross section of FIG. 7.

One of common flow passage grooves 71 of the second flow passage member 60 is the common supply passages 211 illustrated in FIG. 8, and the other one is the common collecting passages 212. In both grooves, the ink flows between a first end side and a second end side of the liquid discharge head 3 in the longitudinal direction.

Figure 7:
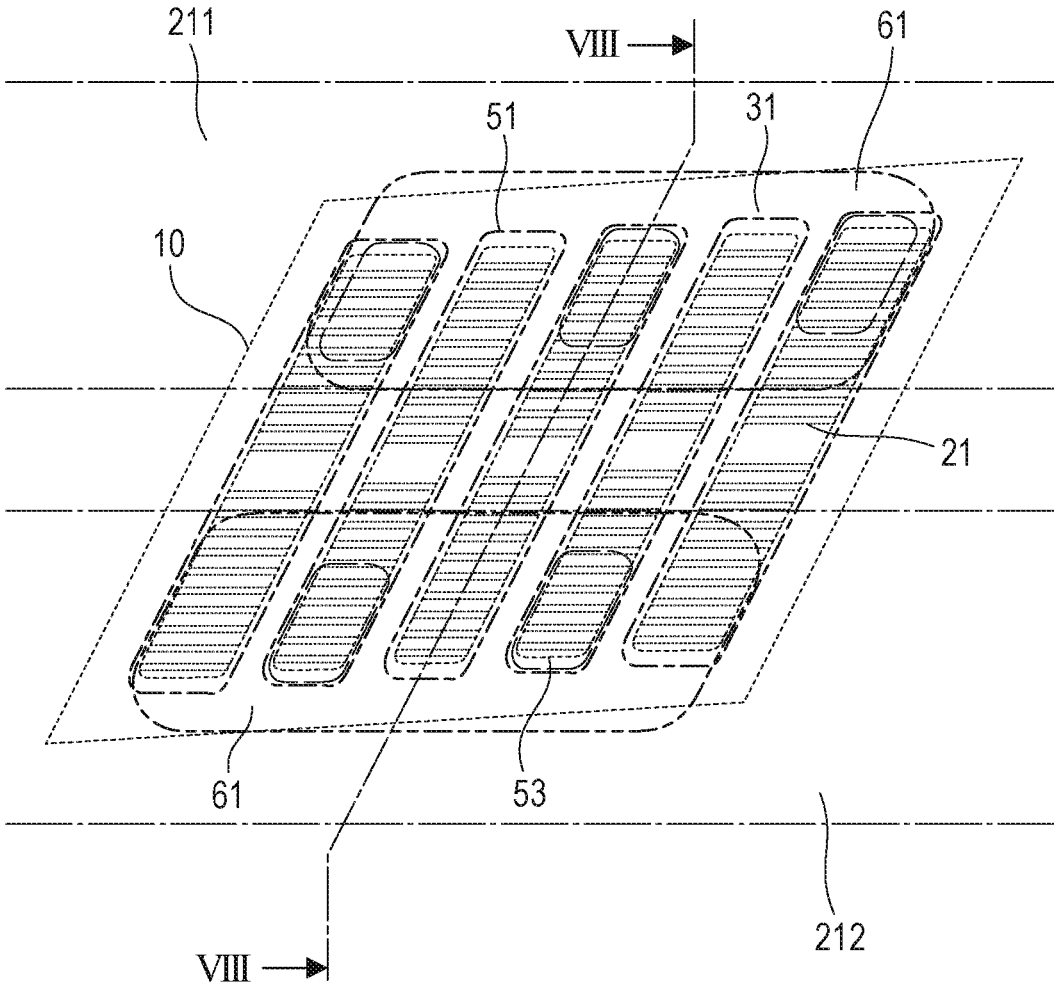
FIG. 7 is a transparent view illustrating a relationship of a connection between printing element substrates and the flow passage member.

FIG. 7 is a transparent view illustrating a relationship of the ink connection between the printing element substrates 10 and the flow passage member 210. As illustrated in FIG. 7, a pair of common supply passages 211 and common collecting passages 212 that extend in the longitudinal direction of the liquid discharge head 3 are provided inside the flow passage member 210. The communication ports 61 of the second flow passage member 60 are connected to the individual communication ports 53 of the first flow passage members 50 while matching the position therewith, and a supply path that communicates communication ports 72 of the second flow passage member 60 and the communication ports 51 of the first flow passage members 50 to each other through the common supply passages 211 is formed. Similarly, a collection path that communicates the communication ports 72 of the second flow passage member 60 and the communication ports 51 of the first flow passage members 50 to each other through the common collecting passages 212 is formed as well.

FIG. 8 is a cross-sectional view taken along line VIII-VIII in FIG. 7. As illustrated in the diagram, the common supply passages 211 is connected to the discharge module 200 through the communication ports 61, the individual communication ports 53, and the communication ports 51. In other words, the individual supply passages 213*a* (FIG. 2, FIG. 3) are formed so as to include the communication ports 61, the individual communication ports 53, and the communication ports 51. While not illustrated in FIG. 8, in another cross section, it is apparent by referring to FIG. 7 that the individual collecting passages 213*b* are connected to the discharge module 200 through similar paths. Flow passages that communicate with discharge openings 13 are formed in the printing element substrates 10, and a portion or all of the supplied ink is allowed to pass through the discharge openings 13 (pressure chambers 23) that have stopped the discharging operation and is allowed to flow back. Furthermore, the common supply passages 211 is connected to the negative pressure control unit 230 (the high pressure side), and the common collecting passages 212 is connected to the negative pressure control unit 230 (the low pressure side) through the supply units 220. With the above pressure difference, a flow that flows from the common supply passages 211, that passes through the discharge openings 13 (the pressure chambers 23) of the printing element substrates 10, and that flows to the common collecting passages 212 is generated.

Discharge Module

Figure 9A:
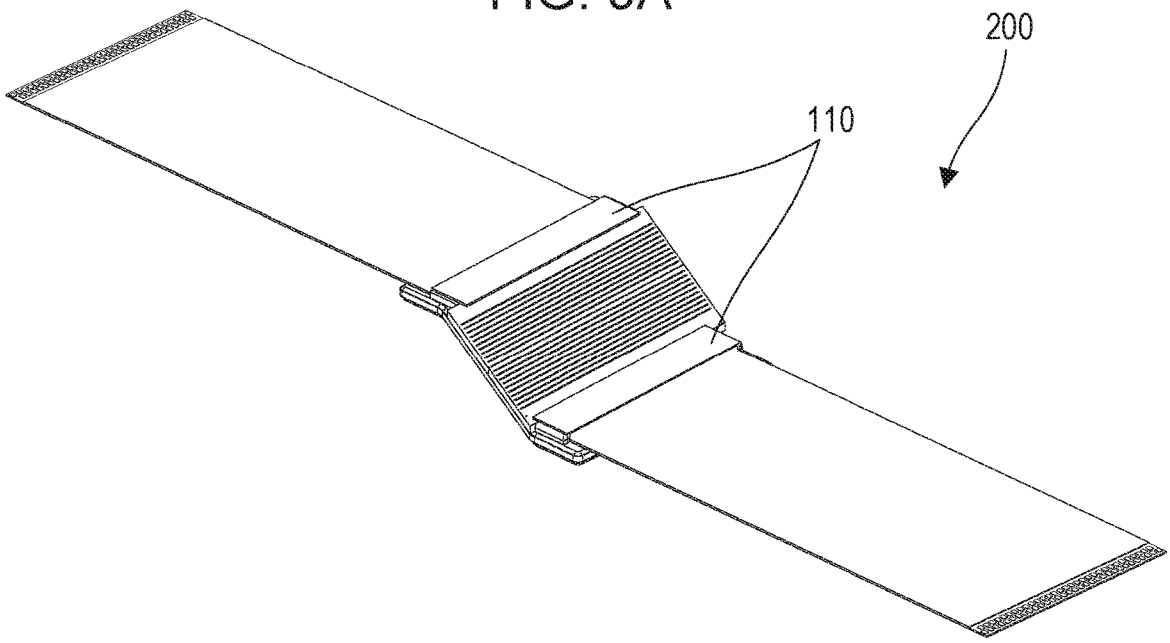
FIGS. 9A and 9B are perspective views of a discharge module.
Figure 9B:
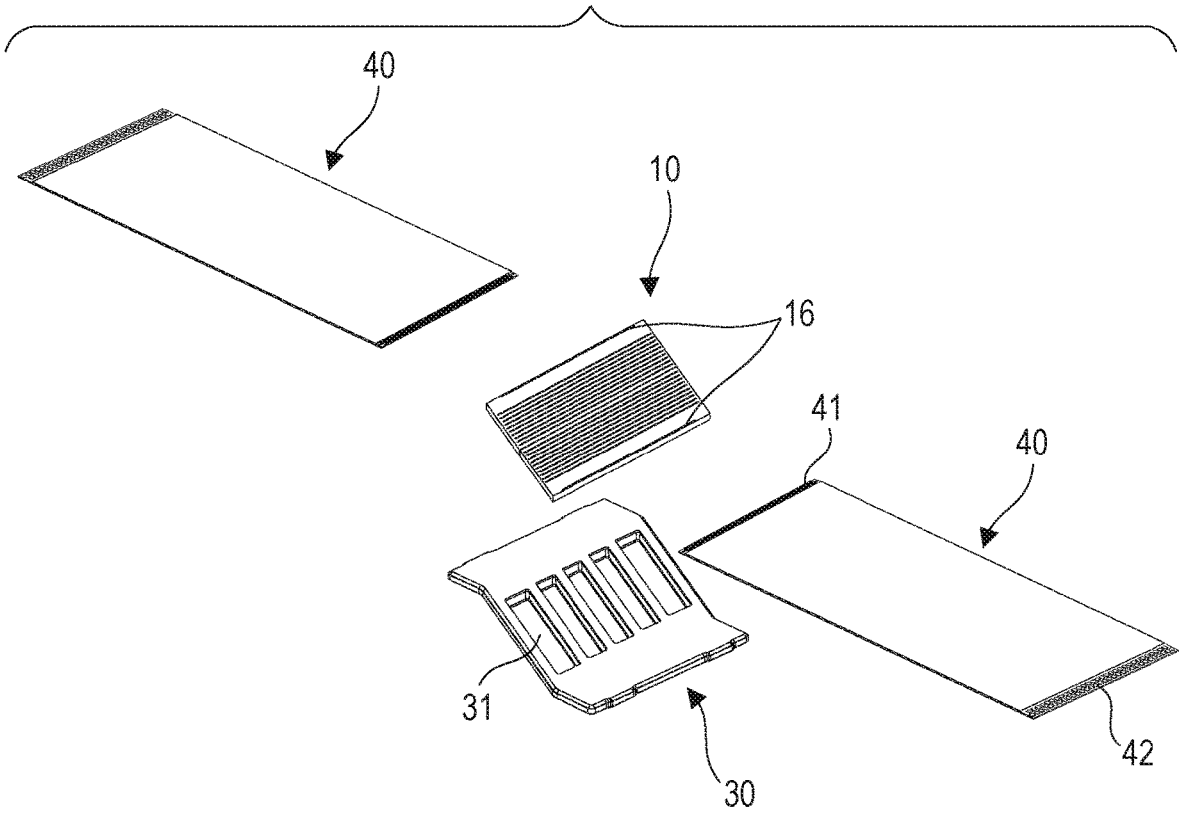

FIG. 9A illustrates a perspective view of a single discharge module 200 and FIG. 9B illustrates an exploded view of the discharge module 200. The discharge module 200 includes the printing element substrate 10, a supporting member 30, and flexible wiring substrates 40.

An example of a method of manufacturing the discharge module 200 will be described. The printing element substrate 10 and the flexible wiring substrates 40 are first adhered on the supporting member 30 provided with communication ports 31. Subsequently, terminals 16 on the printing element substrate 10 and terminals 41 on the flexible wiring substrates 40 are electrically connected by wire bonding, and wire bonding portions (electric connection portions) are covered and sealed with the sealing members 110. Terminals 42 of the flexible wiring substrates 40 on the side opposite to the printing element substrates 10 are electrically connected to the connection terminals of the electric wiring substrates 90. Since the supporting member 30 is not only a supporting portion that supports the print element substrate 10 but also is a flow passage member that fluidly communicates the printing element substrate 10 and the flow passage member 210 to each other, the material of the supporting member 30, desirably, has high degree of flatness and is capable of adhering to the printing element substrate 10 with high reliability. The material is desirably alumina or a resin material, for example.

Note that the plurality of terminals 16 are disposed an both side portions (the long side portions of the printing element substrate 10) and in the column direction of the plurality of discharge openings of the printing element substrate 10. Two flexible wiring substrates 40, which are electrically connected to the plurality of terminals 16, are disposed to a single printing element substrate 10. With the above configuration, the longest distance from the terminals 16 to the printing element is shortened so that a decrease in voltage and a delay in signal transmission occurring in the wiring portion in the printing element substrate 10 can be reduced.

Printing Element Substrate

Figure 10A:
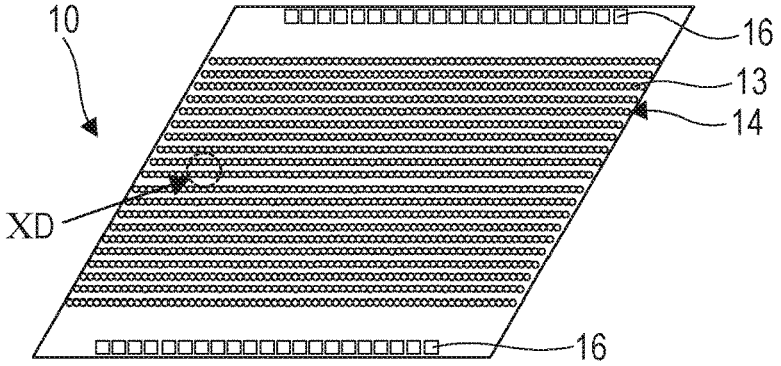
FIGS. 10A to 10D are plan views of a printing element substrate.
Figure 10B:
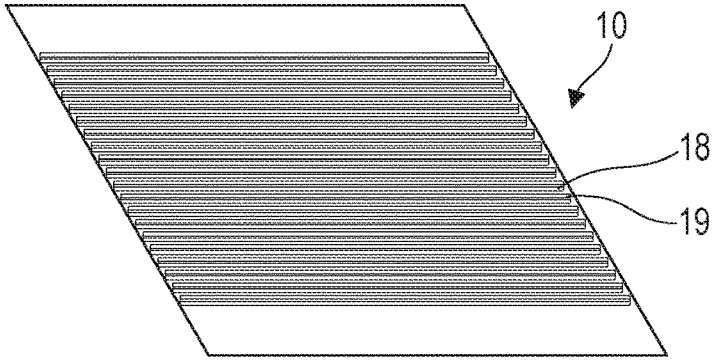
Figure 10C:
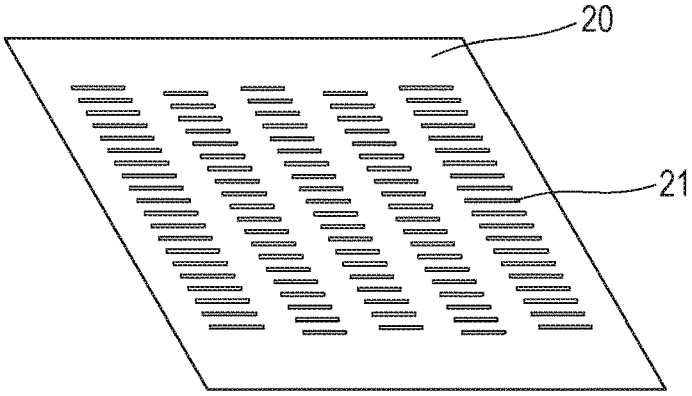
Figure 10D:
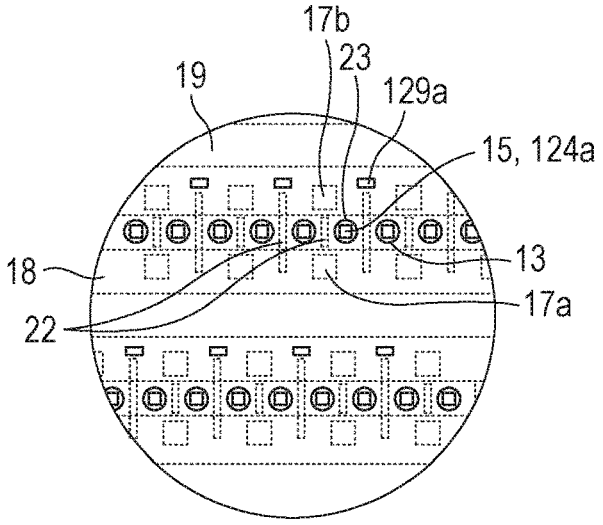
Figure 11:
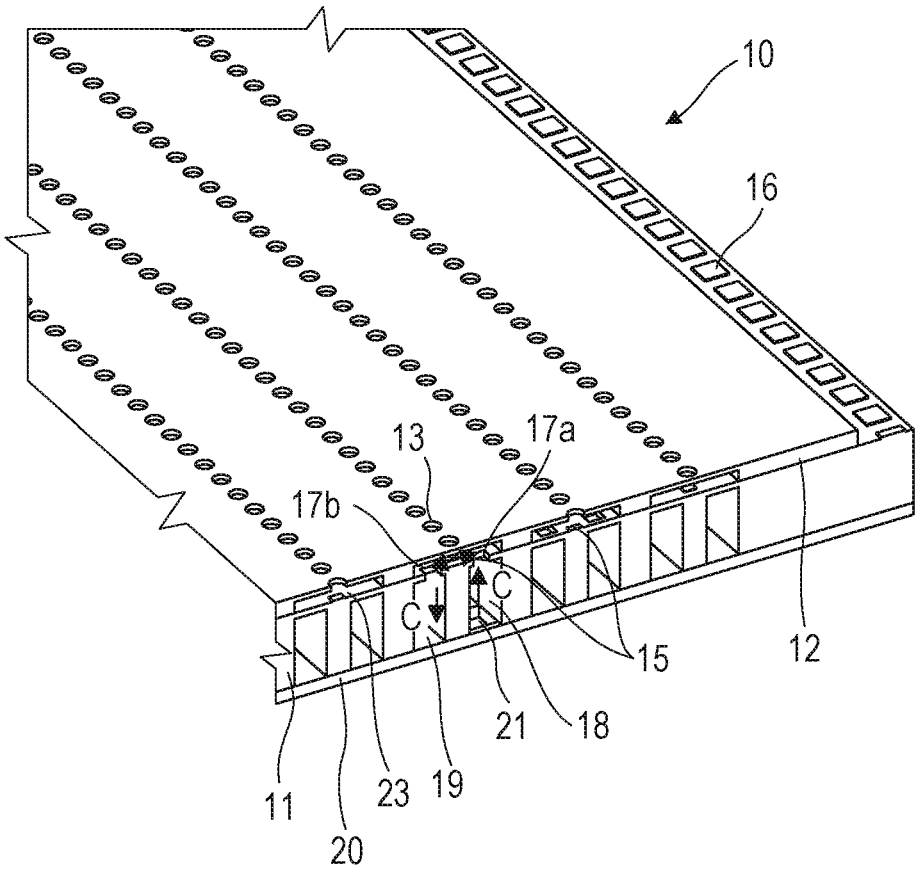
FIG. 11 is a perspective view illustrating a cross section of the printing element substrate.

FIG. 10A is a schematic diagram of a surface of the printing element substrate 10, serving as a substrate of the liquid discharge head, on the side in which the discharge openings 13 are provided and FIG. 10C is a schematic diagram illustrating a back surface of the surface in FIG. 10A. FIG. 10B is a schematic diagram illustrating a surface of the printing element substrate 10 in FIG. 10C in which a cover member 20 provided on the back surface side of the printing element substrate 10 has been removed. FIG. 10D is an enlarged view of a portion in FIG. 10A surrounded by a broken line XD. FIG. 11 is a perspective view illustrating a cross section of the printing element substrate 10.

The printing element substrate 10 includes a substrate 11 which is formed by laminating a plurality of layers on a silicon base 120, a discharge opening forming member 12 formed of a photosensitive resin, and the cover member 20 that is adhered to a back surface of the substrate 11. A plurality of discharge opening arrays 14 are formed in the discharge opening forming member 12 of the printing element substrates 10. Note that hereinafter, a direction in which the discharge open arrays 14 in which the plurality of discharge openings 13 are arranged extends will be referred to as "discharge opening column direction". Printing elements 15 are formed in the substrate 11, and grooves that form supply passages 18 and collecting passages 19 are formed on the back surface side so as to extend in the discharge opening column direction. The printing elements 15 are elements that generate energy used to discharge the liquid. As illustrated in FIG. 10B, the supply passages 18 and the collecting passages 19 that extend in the discharge opening column direction are provided in the back surface of the printing element substrate 10, and a supply passage 18 is provided on one side of each discharge opening array 14 and a collecting passage 19 is provided on the other side of each discharge opening array 14. Furthermore, the supply passages 18 and the collecting passages 19 are provided alternately in a direction that intersects the discharge opening column direction.

Furthermore, as illustrated in FIG. 10D, a plurality of supply ports 17*a* connected to the supply passages 18 are arranged forming supply port rows in the discharge opening column direction. A plurality of collection ports 17*b* that are connected to the collecting passages 19 form arrays of collection ports.

As illustrated in FIGS. 10C and 11, sheet-shaped cover members 20 is laminated on the back side of the surface of the substrate 11 on which the discharge opening forming member 12 is provided. The cover member 20 is supplied with a plurality of openings 21 that communicate with the supply passages 18 and the collecting passages 19. The openings 21 of the cover member 20 are in communication with the communication ports 51 of the first flow passage members 50 through the communication ports 31 of the supporting member 30. The cover member 20 functions as a cover that forms portions of the walls of the supply passages 18 and the collecting passages 19 formed on the substrate 11 of the printing element substrate 10. The cover member 20 is desirable a member that has sufficient anti-corrosion characteristic to ink and the opening shapes and the opening positions of the openings 21 are required to be highly accurate. Accordingly, it is desirable that a photosensitive material or a silicon plate is used as the material of the cover member 20, and it is desirable that the openings 21 are provided through a photo lithography process. As described above, the cover member changes the pitch of the flow passage with the opening 21, and when taking the pressure loss into consideration, it is desirable that the thickness of the cover member is thin and it is desirable that the cover member is formed of a film-like member.

As illustrated in FIG. 11, printing elements 15 serving as heat generating elements that forms bubble in the ink with heat energy are disposed at positions corresponding to the discharge openings 13. The pressure chambers 23 including therein the printing elements 15 are partitioned with partitions 22 (FIG. 10D). The printing elements 15 are electrically connected to the terminals 16 in FIG. 10A with electric wiring provided in the printing element substrate 10. Based an pulse signals input from a control circuit of the printer 1000 and through the electric wiring substrates (FIG. 5) and the flexible wiring substrates 40 (FIG. 9B), the printing elements 15 generate heat and boils the ink. With the bubbling force generated by boiling, the ink is discharged through the discharge openings 13. Note that while the printing elements 15 are, as described later, covered by a plurality of layers provided on the substrate 11, in FIGS. 10D and 11, the printing elements 15 are schematically illustrated on the surface of the substrate 11.

Flow of the ink inside the printing element substrate 10 will be described next. The supply passages 18 and the collecting passages 19 formed by the substrate 11 and the cover member 20 are each connected to the common supply passage 211 and the common collecting passage 212 in the flow passage member 210, and a pressure difference is created between the supply passages 18 and the collecting passages 19. When the ink is discharged from the plurality of discharge openings 13 of the liquid discharge head 3, in the discharge openings that is not performing the discharging operation, ink flows from the supply passages 18 to the collecting passages 19 through the supply ports 17*a*, the pressure chambers 23, and the collection ports 17*b* with the above pressure difference (arrows C in FIG. 11). With the above flow, thickened ink created by evaporation of ink from the discharge openings 13 and bubbles and foreign substance can be collected in the collecting passages 19 in the discharge openings 13 and the pressure chambers 23 that have stopped printing. Furthermore, thickening of ink in the discharge openings 13 and the pressure chambers 23 can be suppressed. The ink that has been collected in the collecting passages 19 is collected in the order of the communication ports 51 of the flow passage member 210, the individual collecting passages 213*b*, and the common collecting passage 212 through the openings 21 of the cover member 20 and the communication ports 31 of the supporting member 30 (FIG. 8), and is ultimately collected in the supply path of the printer 1000.

Note that as illustrated in FIGS. 2 and 3, not all of the ink that has flowed in from a first end of the common supply passage 211 of the discharge unit 300 is supplied to the pressure chambers 23 through the individual supply passages 213*a*. In other words, there is ink that does not flow into the individual supply passages 213*a* but flows to the supply units 220 from a second end of the common supply passage 211. As described above, by including a path in which the ink flows without passing through the printing element substrate 10, backflow of the circulating flow of the ink can be suppressed even in a case of the present exemplary embodiment that includes the printing element substrates 10 that are provided with minute flow passages with a large flow resistance. In the liquid discharge head 3 of the present exemplary embodiment, thickening of the ink in the pressure chambers 23 and in the vicinity of the discharge openings 13 can be suppressed in the above manner; accordingly, discharge position error and ink non-discharge can be prevented and, as a result, high quality printing can be performed.

Figure 12A:
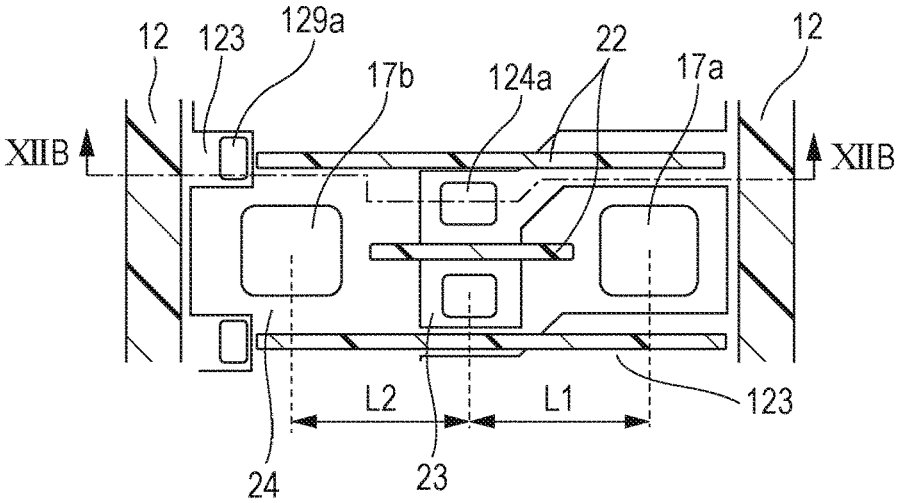
FIGS. 12A to 12C are diagrams illustrating the printing element substrate of a first exemplary embodiment.
Figure 12B:
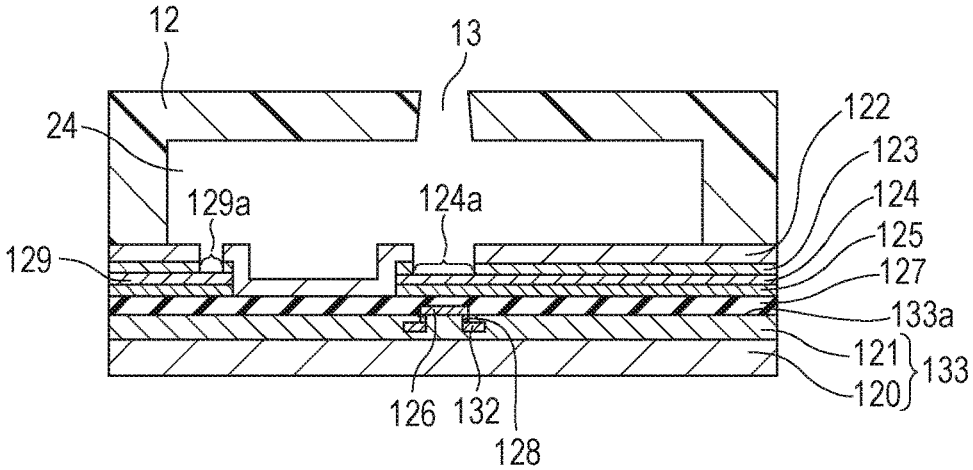

FIG. 12A is a plan view schematically illustrating a surface of the printing element substrate 10 on which the heat applying portions 124*a* are provided and illustrates, in an enlarged manner, a portion near a heat applying portion 124*a*. Furthermore, FIG. 12B is a schematic cross-sectional view taken along line XIIB-XIIB in FIG. 12A. Note that in FIG. 12A, a second adhesive layer 122 illustrated in FIG. 12B is omitted. Note that the heat applying portions 124*a* are portions that are in contact with the ink to create a bubble in the ink and are portions that apply heat to the ink.

The substrate 11 included in the printing element substrate 10 is formed by laminating a plurality of layers on the silicon base 120. In the present exemplary embodiment, a heat accumulating layer 121 formed by a thermally oxidized film, a SiC film, a SiN film, and the like is disposed on the silicon base 120. Furthermore, heat generating elements 126 serving as the printing elements 15 are disposed on the heat accumulating layer 121. A base 133 includes the silicon base 120 and the heat accumulating layer 121, and the heat generating elements 126 are provided on a surface 133*a* side of the base 133. An electrode layer 132 serving as wiring formed of a metal material, such as Al, Al—Si, and Al—Cu, is connected to the heat generating elements 126 through plugs 128 formed of tungsten or the like. A pair of plugs 128 are disposed in each heat generating element 126, and among the heat generating elements 126, the portion where the current flows through the plugs 128 functions as the heat generation portion for discharging ink. The plugs 128 and the electrode layer 132 are formed inside the heat accumulating layer 121. An insulating protection layer 127 is provided on the heat generating elements 126 so as to cover the heat generating elements 126. The insulating protection layer 127 is formed of a SiC film, a SiN film, for example.

A first protective layer 125 and a second protective layer 124 are disposed on the insulating protection layer 127. Such protective layers include a function of protecting the surfaces of the heat generating elements 126 from the chemical and physical impact created by heat generation of the heat generating elements 126. For example, the first protective layer 125 is formed of tantalum (Ta), and the second protective layer 124 is formed of iridium (Ir). Furthermore, the protective layers formed of such materials have electrical conductivity.

Furthermore, a first adhesive layer 123 and the second adhesive layer 122*a* are disposed on the second protective layer 124. The first adhesive layer 123 has a role of improving the adhesiveness between the second protective layer 124 and other layers, and the first adhesive layer 123 is formed of tantalum (Ta), for example. The second adhesive layer 122 has a role of protecting the other layer from ink and improving the adhesiveness between the discharge opening forming member 12. The second adhesive layer 122 is formed of SiC or SiCN, for example.

The discharge opening forming member 12 is adhered to a surface of the substrate 11 on the second adhesive layer 122 side, and forms, with the substrate 11, flow passages 24 including the pressure chambers 23. The flow passages 24 include the supply ports 17*a* and the collection ports 17*b*, and are areas surrounded by the discharge opening forming member 12 and the substrate 11. Furthermore, the discharge opening forming member 12 includes the partitions 22 provided between adjacent heat applying portions 124*a*. The pressure chambers 23 are partitioned with the partitions 22.

When a discharge of ink is performed, the temperature of the ink instantaneously increases on the heat applying portion 124*a* that, among the second protective layer 124, covers the heat generating element 126 and that is in contact with the ink, the ink becomes bubbled, and becomes debubbled such that a cavitation is created. Accordingly, the second protective layer 124 including the heat applying portion 124*a* is formed of iridium that has a high anti-corrosion characteristic and a high cavitation resistance. The heat applying portions 124*a* of the second protective layer 124 are, when viewed in a direction orthogonal to the surface 133*a* of the base 133, disposed between the supply ports 17*a* and the collection ports 17*b*. Note that "disposed between the supply ports 17*a* and the collection ports 17*b*" refers to at least portions of the heat applying portions 124*a* being positioned between the supply ports 17*a* and the collection ports 17*b*.

Furthermore, electrodes 129*a* used in a kogation generation suppressing process described later are disposed inside the flow passages 24 at portions downstream of the heat applying portions 124*a* of the second protective layer 124 in the ink flowing direction flowing from the supply ports 17*a* towards the collection ports 17*b*. In other words, the electrodes 129*a* are disposed on the collection ports 17*b* side with respect to the heat applying portions 124*a*. Furthermore, as illustrated in FIG. 10D, in a case in which the supply ports 17*a* are provided on one side in the arrayed direction of the plurality of heat applying portion 124*a*, and the collection ports 17*b* are disposed on the other side, the electrodes 129*a* are disposed on the collection ports 17*b* side with respect to the array of the heat applying portion. 124*a*. Note that in order to suppress a load on the manufacturing process, the electrode layer 129 constituting the electrodes 129*a* is desirably formed of the same material (iridium) as that of the second protective layer 124. Kogation generation suppressing process In the present exemplary embodiment, in order to suppress kogation that accumulates on the second protective layer 124 on the heat generating element 126 during an ink discharging operation, a kogation generation suppressing process is performed. Specifically, when the heat applying portion 124*a* of the second protective layer 124 is assumed to be a first electrode, and the electrode 129*a* provided inside the same flow passage 24 is assumed to be a second electrode, an electric field is formed using the pair of electrodes. Accordingly, the heat applying portion 124*a* of the second protective layer 124 and the electrode 129*a* are electrically connected to a terminal of the printing element substrate 10 through the wiring inside the printing element substrate 10, and the heat applying portion 124*a* and the electrode 129*a* are configured to be capable of being applied with a potential from a portion external to the printing element substrate 10. Note that in the kogation generation suppressing process, while an electric field is formed in the ink between the heat applying portion 124*a* and the electrode 129*a*, there is to be no current flowing between the heat applying portion 124*a* and the electrode 129*a* through the ink. Aqueous ink that contains water includes pigment (a color material) that is charged to a negative potential.

In the above, by forming an electric field so that the pigment (the color material) charged to a negative potential and particles of an additive and the like included in the ink repel the heat applying portion 124*a* of the second protective layer 124, particles that become the cause of kogation is kept away from the heat applying portion 124*a*. Kogation is a phenomenon in which the pigment (the color material) and additives heated at a high temperature and decomposed at a molecular level change into an insoluble substance and are physically adsorbed on the heat applying portion 124*a* of the second protective layer 124. Accordingly, by decreasing the abundance ratio of the particles, such as the pigment, charged to a negative potential at the vicinity of the heat applying portion 124*a* of the second protective layer 124, kogation accumulating on the heat applying portions 124*a* of the second protective layer 124 on the heat generating element 126 can be suppressed. Note that in a case in which the ink includes particles that are charged to a positive potential, it is only sufficient to form an electric field between the heat applying portion 124*a* and the electrode 129*a* so that the particles charged to a positive potential repel the heat applying portion 124*a*.

As described above, a flow of ink, that is, the ink being supplied to the supply port 17*a* and the ink being collected to the collection port 17*b* is occurring in the pressure chamber 23. In other words, a circulation of ink is generated in the flow passage 24 including the pressure chamber 23, in which the ink supplied from the supply port 17*a* passes through the collection port 17*b* and becomes collected. The circulation of ink occurs at least when the ink discharge operation is performed.

As described above, the electrode 129*a* is disposed downstream of the heat applying portions 124*a* of the second protective layer 124 in the ink flowing direction flowing from the supply port 17*a* to the collection port. 17*b*. Accordingly, the charged particles in the vicinity of the heat applying portions 124*a* of the second protective layer 124 that become the cause of kogation not only receive repulsive force from the heat applying portion 124*a* created by the electric field formed in the ink but also receives inertial force directed towards the electrode 129*a* with the flow of ink. Accordingly, the abundance ratio of the charged particles in the vicinity of the heat applying portion 124*a* that is heated when ink is discharged can be reduced. In the manner described above, by disposing the electrode 129*a* downstream of the heat applying portion 124*a* in the flow direction of the ink circulation and by performing the kogation generation suppressing process in which, while distributing the ink, an electric field is formed in the ink to repel the charged particles from the heat applying portion 124*a*, the occurrence of kogation can be suppressed further.

Furthermore, in the present exemplary embodiment, the electrode 129*a* is not disposed between the heat applying portion 124*a* of the second protective layer 124 and the collection port 17*b* and is disposed at a position away from the heat applying portion 124*a* with respect to an end portion of the collection port 17*b* that is closer to the near applying portion 124*a*. By disposing the electrode 129*a* in the above manner, the distance L2 between the heat applying portion 124*a* and the collection port 17*b* can be suppressed from becoming long. Furthermore, the distance L1 between the heat applying portion 124*a* and the supply port 17*a* and the distance L2 between the heat applying portion 124*a* and the collection port 17*b* can be short and both distances can be the same. With the above, after forming a bubble for discharging ink, the ink can be filled from both the supply port 17*a* and the collection port 17*b* and the ink filling time can be shorter; accordingly, a high speed drive of the liquid discharge head 3 can be achieved.

Note that as described above, after forming the bubble for discharging ink, since the ink is supplied from both the supply port 17*a* and the collection port 17*b*, although the flow of the ink inside the flow passage 24 immediately after the formation of the bubble temporarily changes, subsequently, the ink flows in a direction from the supply port 17*a* to the collection port 17*b*. The ink flowing direction is not the ink flowing direction that changes temporarily as above but refers to a steady flowing direction from the supply port 17*a* towards the collection port 17*b*.

Figure 12C:
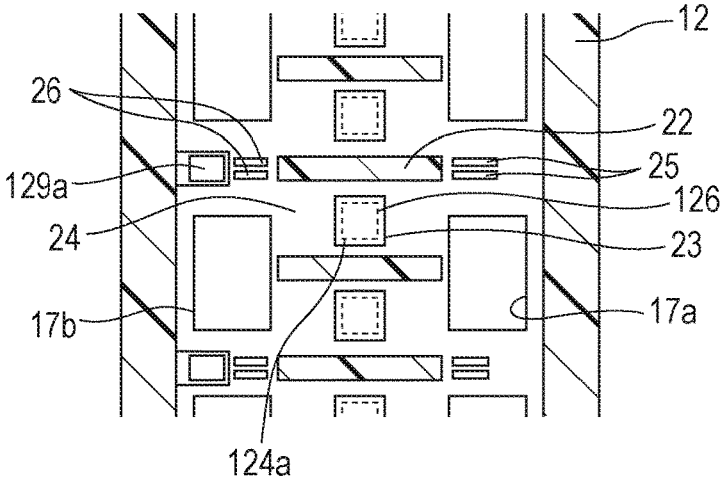

Furthermore, in the present exemplary embodiment, while the supply ports 17*a* and the collection ports 17*b* are openings open in the surface of the substrate 11, the supply ports 17*a* and the collection ports 17*b* may be openings formed in a surface that intersects the surface of the substrate 11. For example, the supply ports 17*a* and the collection ports 17*b* may be provided between the substrate 11 and the discharge opening forming member 12. In other words, in the present disclosure, it s only sufficient that, separate from the discharge openings 13, there is a flow passage in which the ink passes through the heat applying portion 124*a*, and that the electrodes 129*a* are provided downstream of the heat applying portion 124*a*. FIG. 12C is a plan view schematically illustrating a surface of the printing element substrate 10, which is a modification example of the present exemplary embodiment, on which the heat applying portions 124*a* are provided and illustrates, in an enlarged manner, a portion near a heat applying portion 124*a*. In the present modification example, the partitions 22 that partition the pressure chambers 23, the partitions 25 provided between adjacent supply ports 17*a*, and the partitions 26 provided between adjacent collection ports 17*b* are divided into parts. In other words, in the present disclosure, the flow passages 24 may be formed by such divided partitions, and it is only sufficient that the electrodes 129*a* are provided downstream of the heat applying portion 124*a* in the ink flowing direction of the flow passages 24.

Figure 13:
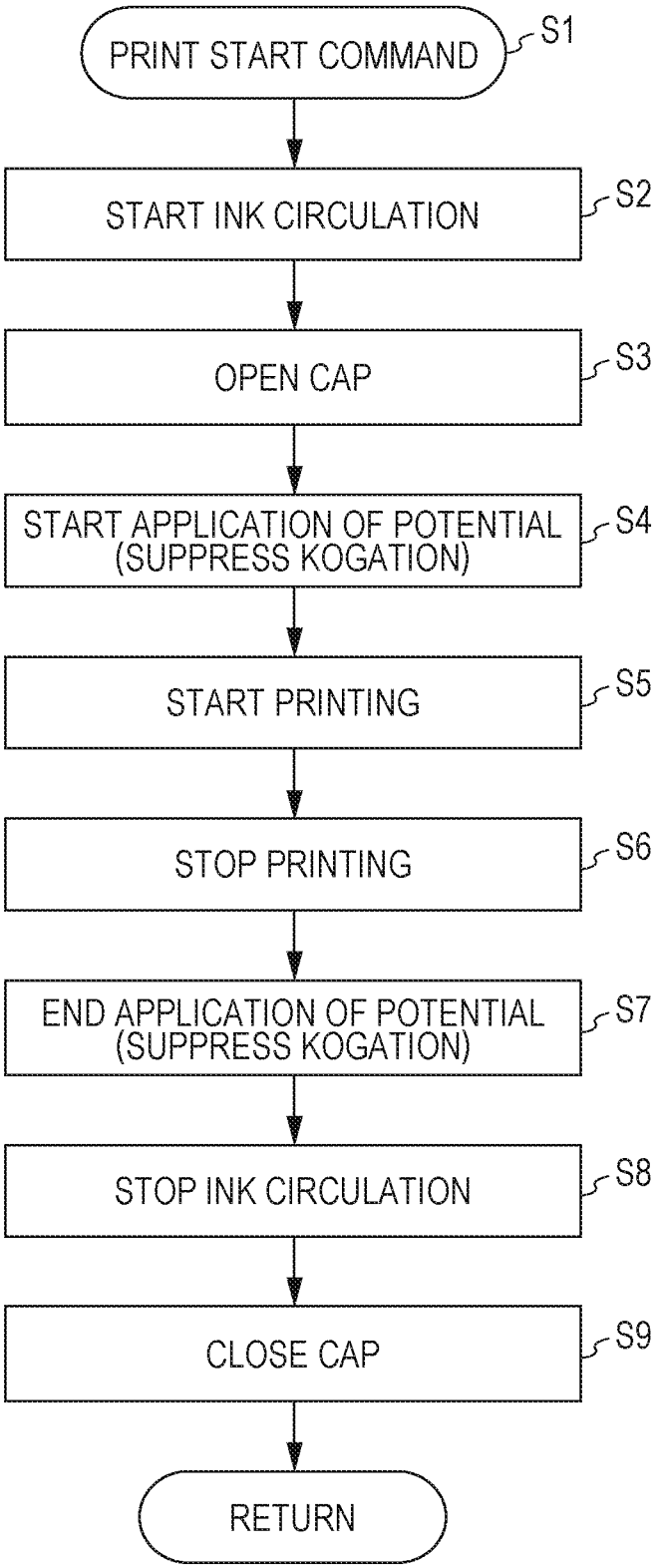
FIG. 13 is a diagram illustrating a flow of a print operation.

FIG. 13 illustrates a flow of a print operation according to the present exemplary embodiment. When a print start command is input to the ink jet printer (S1), ink circulation inside the flow passages 24 of the liquid discharge heads 3 is started (S2). Subsequently, the caps of the liquid discharge heads are removed (S3), the kogation generation suppressing process is started (S4), and electric fields are formed between the heat applying portions 124*a* of the second protective layer 124 and the electrodes 129*a*. In so doing, a voltage is applied to portions between the heat applying portions 124*a* and the electrodes 129*a* from a voltage applying member, which is provided in the printer 1000 main body, through the electric wiring substrates 90, the flexible wiring substrates 40, internal wiring of the printing element substrates 10, and the like. For example, in order to have the particles charged to a negative potential repel the heat applying portions 124*a*, while having e potential of the heat applying portion 124*a* as a ground potential, a potential in the range of +0.10 V to +2.5 V, inclusive, is applied to the electrodes 129*a*. Subsequently, the ink is discharged and printing is started (S5).

The printing is completed (S6) and, subsequently, the kogation generation suppressing process is ended (S7). Subsequently, ink circulation is stopped (S8), and the liquid discharge heads become closed with caps (S9).

Note that the print operation (the ink discharging operation) according to the present exemplary embodiment not only includes the period in which the liquid discharge heads discharge ink and printing is performed but also includes the period from when the print start command is received and to when the ink discharge is ended.

Furthermore, the values of the potential described above is an example, and it is only sufficient that a voltage is applied between the heat applying portions 124*a* and the electrodes 129*a* so that the charged particles repel the heat applying portions 124*a*. In other words, a potential may be applied on the heat applying portion 124*a* sides, and the potential of the electrodes 129*a* may be the ground potential. Alternatively, a potential may be applied to both the heat applying portions 124*a* and the electrodes 129*a*.

Note that in order to efficiently have the particle charged to a negative potential repel the heat applying portions 124*a*, the potential of the electrodes 129*a* with respect to the heat applying portions 124*a* is preferably +0.10 V or higher. Furthermore, in a case in which the heat applying portions 124*a* and the electrodes 129*a* are formed so as to include iridium, it is preferable that the potential of the electrodes 129*a* with respect to the heat applying portions 124*a* is +2.5 V or lower. When set larger than +2.5 V, an electrochemical reaction occurs between the electrodes 129*a* and the ink and the iridium included in the electrodes 129*a* may melt out to the ink. As a result, a current will flow between the heat applying portions 124*a* and the electrodes 129*a* through the ink. Accordingly, when the kogation generation suppressing process is performed, while forming the electric fields in the ink between the heat applying portions 124*a* and the electrodes 129*a*, a state in which the current does not flow between both electrodes through the ink is provided.

Second Exemplary Embodiment

A liquid discharge head 3 according to a second exemplary embodiment will be described. Note that portions that are different from the exemplary embodiment described above will be described mainly and description of the portions that are similar to those of the exemplary embodiment described above may be omitted.

Figure 14A:
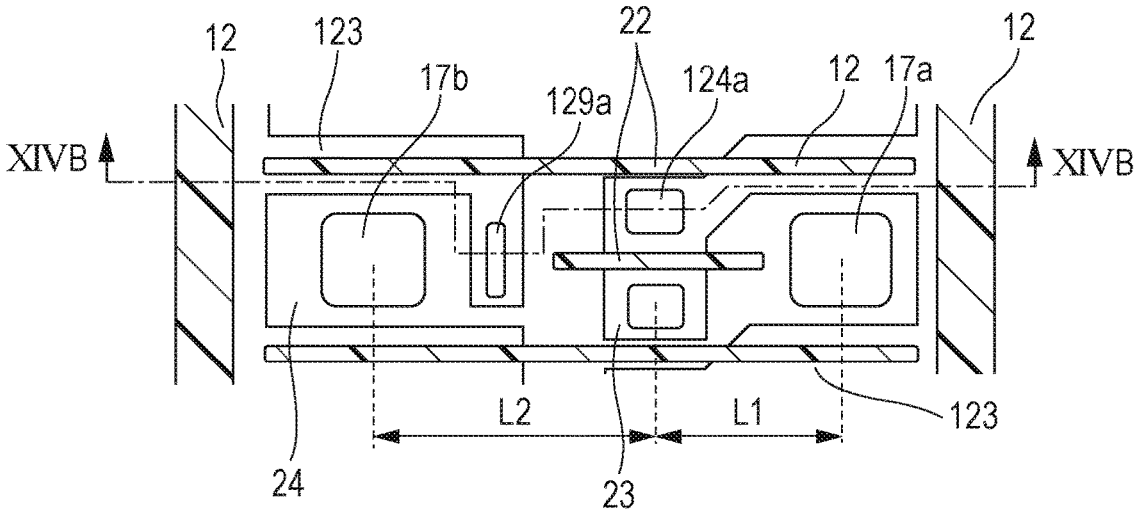
FIGS. 14A and 14B are diagrams illustrating a printing element substrate of a second exemplary embodiment.
Figure 14B:
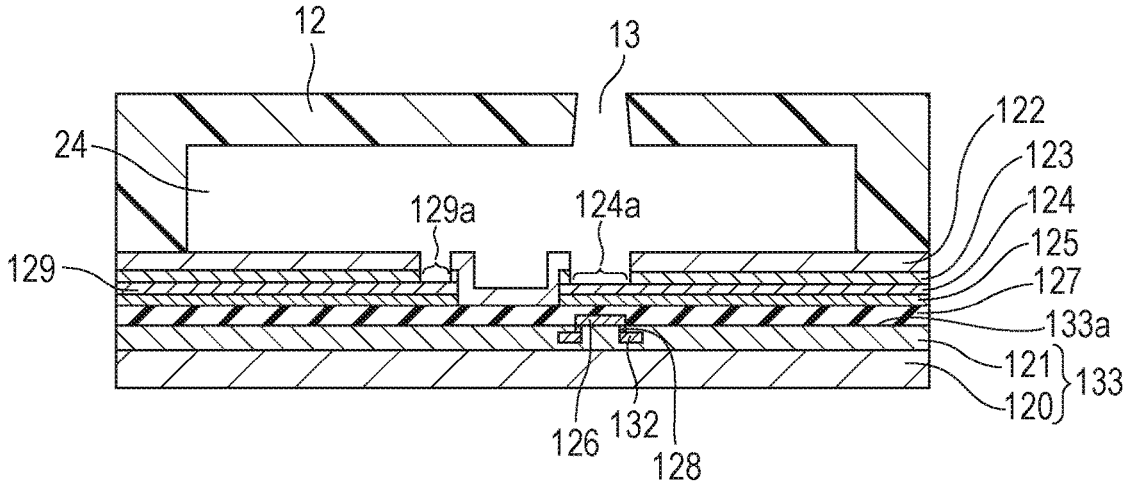

FIG. 14A is a plan view schematically illustrating a surface of the printing element substrate 10 on which the heat applying portions 124*a* are provided and illustrates, in an enlarged manner, a portion near a heat applying portion 124*a*. Furthermore, FIG. 14B is a schematic cross-sectional view taken along line XIVB-XIVB in FIG. 14A. Note that in FIG. 14A, a second adhesive layer 122 illustrated in FIG. 14B is omitted.

In the present exemplary embodiment as well, an ink circulation configuration is employed in the flow passage 24 in which the ink supplied from the supply port 17*a* passes through the collection port 17*b* and becomes collected. In the heat applying portions 124*a* on the heat generating element 126, at least during the ink discharging operation, the ink is flowing in the direction from the supply port 17*a* to the collection port 17*b*. Furthermore, the electrode 129*a* is disposed downstream of the heat applying portions 124*a* of the second protective layer 124 in the ink flowing direction flowing from the supply port 17*a* to the collection port 17*b*.

In the present exemplary embodiment, the electrode 129*a* is disposed between the heat applying portions 124*a* of the second protective layer 124 and the collection port 17*b*. By forming an electric field through the ink between the heat applying portions 124*a* of the second protective layer 124 and the electrode 129*a*, particles, such as pigment in the ink, charged to a negative potential repel from the heat applying portions 124*a* of the second protective layer 124 on the heat generating element 126.

In the present exemplary embodiment, the distance between the heat applying portion 124*a* and the electrode 129*a* is short, and charged particles 141 can be made to repel more easily from the heat applying portion 124*a* with the electric field formed between the heat applying portion 124*a* and the electrode 129*a*. Accordingly, from the viewpoint of suppressing generation of kogation, the configuration such as the present exemplary embodiment is desirable. Note that if the electrode 129*a* is disposed between the heat applying portions 124*a* and the collection port 17*b*, the distance L2 between the heat applying portions 124*a* and the collection port 17*b* becomes longer accordingly, and the distance L2 will become longer than the distance L1 between the heat applying portions 124*a* and the supply port 17*a*. Note that the distance L1 between the heat applying portions 124*a* and the supply port 17*a* may be increased so that the distance L1 is the same as distance L2 even more.

Third Exemplary Embodiment

A liquid discharge head 3 according to a third exemplary embodiment will be described. Note that portions that are different from the exemplary embodiments described above will be described mainly and description of the portions that are similar to those of the exemplary embodiments described above may be omitted.

Figure 15A:
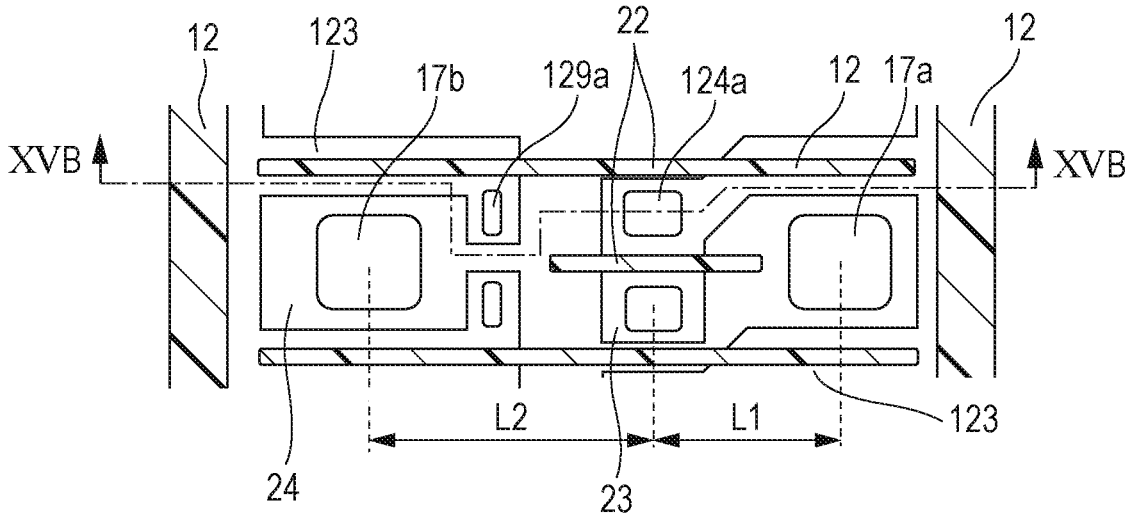
FIGS. 15A and 15B are diagrams illustrating a printing element substrate of a third exemplary embodiment.
Figure 15B:
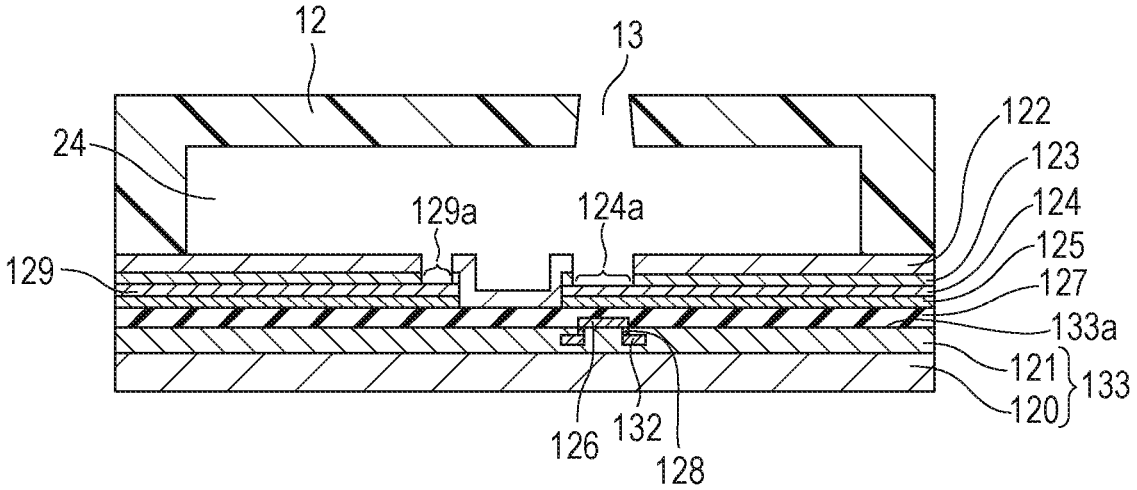

FIG. 15A is a plan view schematically illustrating a surface of the printing element substrate 10 on which the heat applying portions 124*a* are provided and illustrates, in an enlarged manner, a portion near a heat applying portion 124*a*. Furthermore, FIG. 15B is a schematic cross-sectional view taken along line XVB-XVB in FIG. 15A. Note that in FIG. 15A, a second adhesive layer 122 illustrated in FIG. 15B is omitted.

In the present exemplary embodiment as well, an ink circulation configuration is employed in the flow passage 24 in which the ink supplied from the supply port 17*a* passes through the collection port 17*b* and becomes collected. In the heat applying portions 124*a* on the heat generating element 126, at least during the ink discharging operation, the ink is flowing in the direction from the supply port 17*a* to the collection port 17*b*. Furthermore, the electrode 129*a* is disposed downstream of the heat applying portions 124*a* of the second protective layer 124 in the ink flowing direction flowing from the supply port 17*a* to the collection port 17*b*.

In the present exemplary embodiment, the electrode 129*a* is disposed between the heat applying portions 124*a* of the second protective layer 124 and the collection port 17*b*. Furthermore, a single electrode 129*a* is provided to a single heat applying portion 124*a* so that the heat applying portion 124*a* and the electrode 129*a* become a pair.

In the present exemplary embodiment, the distance between the heat applying portion 124*a* and the electrode 129*a* is close and a single electrode 129*a* is provided to a single heat applying portion 124*a*. Accordingly, the charged particles 141 can be made to repel more easily from the heat applying portion 124*a* with the electric field formed between the heat applying portion 124*a* and the electrode 129*a*. Accordingly, from the viewpoint of suppressing generation of kogation, the configuration such as the present exemplary embodiment is more desirable. Note that if the electrode 129*a* is disposed between the heat applying portions 124*a* and the collection port 17*b*, the distance L2 between the heat applying portions 124*a* and the collection port 17*b* becomes longer accordingly, and the distance L2 will become longer than the distance L1 between the heat applying portions 124*a* and the supply port 17*a*. Note that the distance L1 between the heat applying portions 124*a* and the supply port 17*a* may be increased so that the distance L1 is the same as distance L2.

Note that in any one of the embodiments, in order to suppress increase in the area of the printing element substrate 10 due to the arrangement of the electrodes 129*a*, the number of electrodes 129*a* corresponding to a single heat generating element array is set so as to be the same or smaller than the number of heat generating elements 126 included in a single heat generating element array.

Experiment Results of Kogation Generation Suppressing Process

An experiment conducted by the present inventors has revealed that, in the kogation generation suppressing process described above, the degree in which the generation of kogation is suppressed differs according to the disposed position of the electrode 129*a* with respect to the flow direction of the ink circulation. Details of the experiment results will be described below.

In the present experiment, ink was discharged using an ink jet pigment ink and the liquid discharge head illustrated in FIG. 12A, the discharge speed was measured, and the relationship between the ink droplet number and the ink discharge speed was studied. Furthermore, the heat applying portion 124*a* was observed to check whether there were any kogations. FIGS. 16A to 16D are graphs illustrating the relationship between the ink droplet number and the ink discharge speed.

Figure 16A:
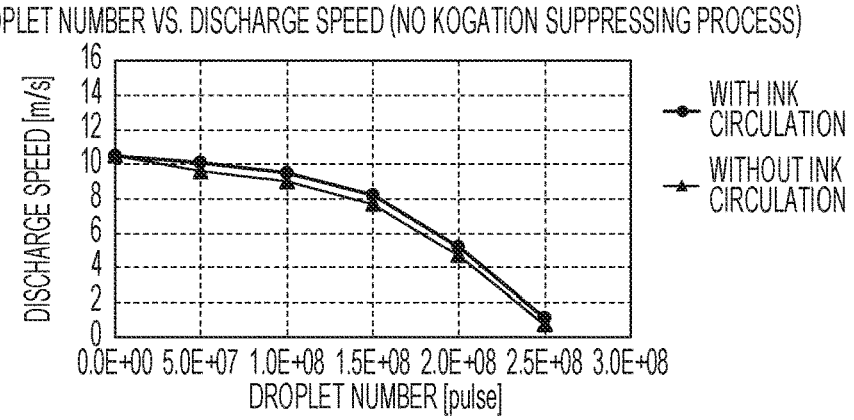
FIGS. 16A to 16D are graphs illustrating relationships between droplet numbers and discharge speeds.

In FIG. 16A, the kogation suppressing process described above was not performed. In other words, it is a graph illustrating a case in which no electric field was generated during the ink discharging operation. Immediately after the start of the discharge, the discharge speed gradually decreased, and at the $1.5\times10^{8th}$ pulse, the discharge speed decreased about 2 m/s compared to the initial discharge speed. At that point, a lot of kogation accumulated on the heat applying portion 124*a* on the heat generating element 126 was visually confirmed. It was conceived that the discharge speed decreased because of the accumulation of the kogation. The kogation further accumulated after the $1.5\times10^{8th}$ pulse, and the discharge speed decreased as well. Note that there were barely no difference between when there was an ink circulation flow inside the pressure chamber 23 and when there was no ink circulation flow therein, and the same tendencies were seen in the case when there were ink circulation and in a case when there were no ink circulation.

Figure 16B:
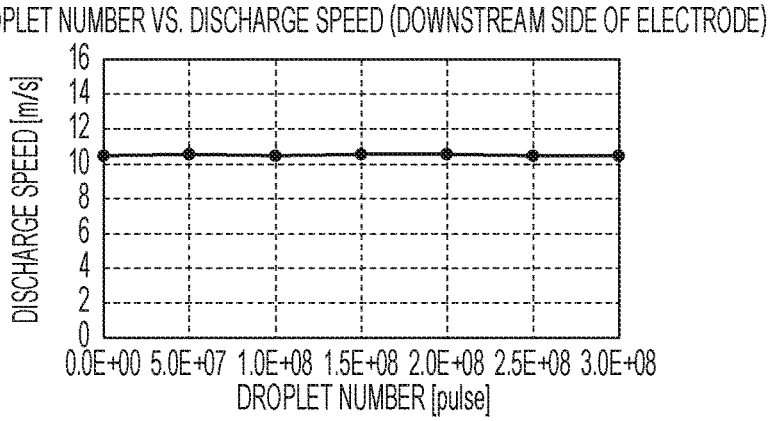

FIG. 16B is a graph illustrating a case in which the kogation suppressing process was performed while distributing ink from the supply port 17*a* to the collection port 17*b*. When the ink was distributed from the supply port 17*a* to the collection port 17*b*, the electrode 129*a* was disposed downstream of the heat applying portions 124*a* of the second protective layer 124 in the ink flowing direction. As the kogation suppressing process, during the ink discharging operation, the heat applying portion 124*a* was the ground potential and a potential of +1.5 V was applied to the other electrodes 129*a*. Note that in the above, while an electric field was formed in the ink between the heat applying portion 124*a* and the electrode 129*a*, no current was flowing. There was no decrease in the discharge speed from the start of the discharging until the $3.0\times10^{8th}$ pulse, and it was visually confirmed at this point that no kogation had accumulated on the heat applying portion 124*a*.

Figure 16C:
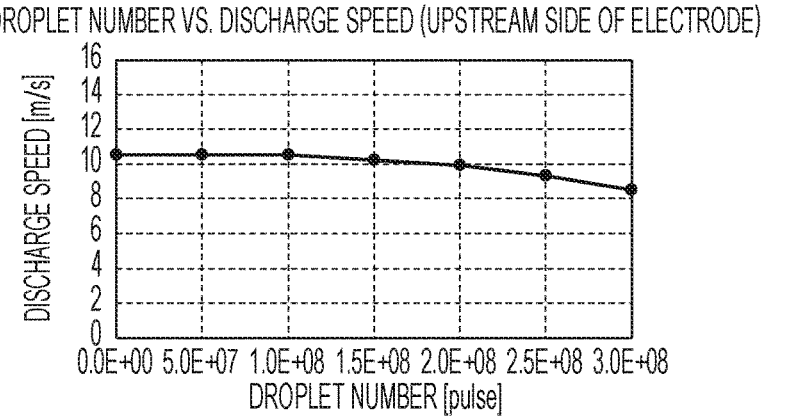

FIG. 16C is a graph illustrating a case in which the kogation suppressing process was performed while ink was distributed in a direction opposite to the ink flowing direction FIG. 16B, in other words, the ink was distributed from the collection port 17*b* to the supply port 17*a*. When the ink was distributed from the collection port 17*b* to the supply port 17*a*, the electrode 129*a* was disposed upstream of the heat applying portions 124*a* of the second protective layer 124 in the ink flowing direction. As the kogation suppressing process, during the ink discharging operation, the heat applying portion 124*a* was the ground potential and a potential of +1.5 V was applied to the electrode 129*a*. Note that in the above, while an electric field was formed in the ink between the heat applying portion 124*a* and the other electrode 129*a*, no current was flowing. From the $2.0\times10^{8th}$ pulse after the start of the discharging, the discharge speed gradually dropped, and at the $3.0\times10^{8th}$ pulse, the discharge speed decreased about 2 m/s compared to the initial discharge speed. At this point, a small amount of kogation on the heat applying portion 124*a* was visually confirmed.

Figure 16D:
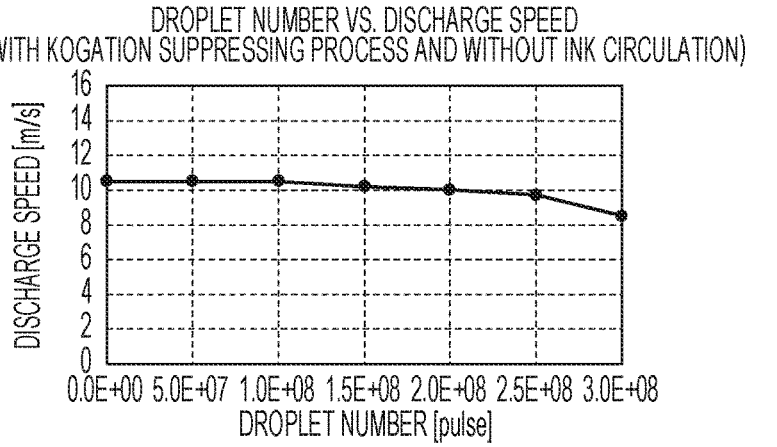

FIG. 16D is a graph illustrating a case in which the kogation suppressing process was performed while no flow of ink from the supply port 17*a* to the collection port 17*b* in the pressure chamber 23 was generated. As the kogation suppressing process, during the ink discharging operation, the heat applying portion 124*a* was the ground potential and a potential of +1.5 V was applied to the electrode 129*a*. Note that in the above, while an electric field was formed in the ink between the heat applying portion 124*a* and the other electrode 129*a*, no current was flowing. From the $2.0\times10^{8th}$ pulse after the start of the discharging, the discharge speed gradually dropped, and at the $3.0\times10^{8th}$ pulse, the discharge speed decreased about 2 m/s compared to the initial discharge speed. At this point, a small amount of kogation on the heat applying portion 124*a* was visually confirmed. The result was substantially the same as the case illustrated in FIG. 16C in which the ink was circulated in the pressure chamber 23 and the electrode 129*a* was disposed upstream in the ink flowing direction.

With the above results, it was confirmed that in a liquid discharge head in which ink was circulated inside the flow passage 24 including the pressure chamber 23, generation of kogation can be suppressed further by disposing the electrode 129*a* that is a second electrode downstream of the heat applying portion 124*a* that is a first electrode in the flow direction of the circulation.

Figure 17A:
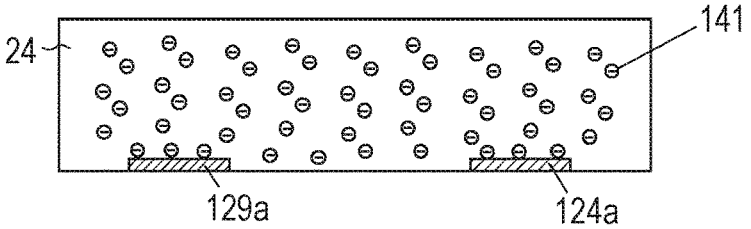
FIGS. 17A to 17E are schematic diagrams for illustrating a kogation generation suppressing process.

The experiment results illustrated in FIGS. 16A to 16D will be described next with reference to FIGS. 17A to 17D. FIG. 17A is a schematic diagram illustrating a state of the particles 141 (pigment particles), which is included in the ink inside the flow passage 24, charged to a negative potential. The heat applying portion 124*a* and the electrode 129*a* are disposed inside the flow passage 24 and ink was filled.

FIG. 17A illustrates a state in which a voltage is not applied to the heat applying portion 124*a* and the electrode

129*a*, and the particles 141 are dispersed inside the ink in a substantially uniform manner.

Figure 17B:
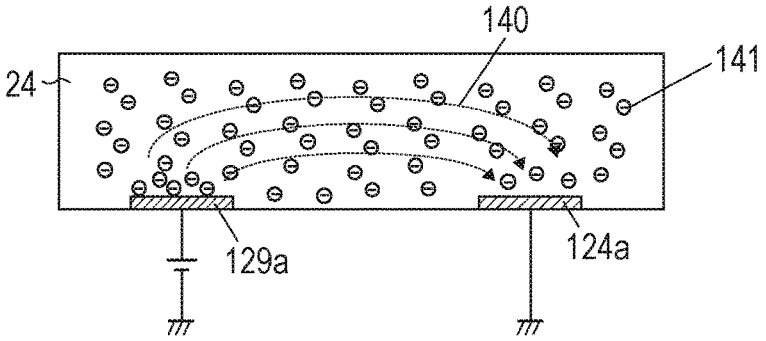
Figure 17C:
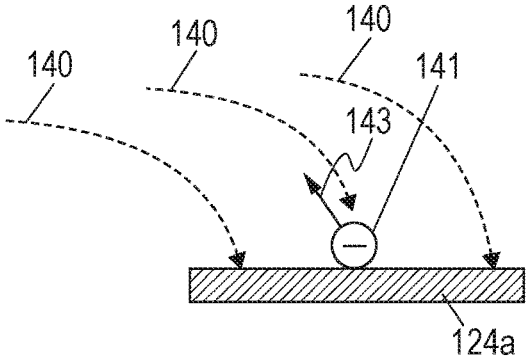

FIG. 17B illustrates a state in which while the heat applying portion 124*a* serving as a first electrode is the ground potential, a potential of +1.5 is applied to the electrode 129*a* serving as a second electrode. An electric field indicated by a broken line arrows 140 is formed. In such a state, since the heat applying portion 124*a* becomes to have a relatively negative potential with respect to the electrode 129*a*, the particles 141 charged with a negative potential repel the heat applying portion 124*a*; accordingly, the abundance ratio of the charged particles 141 in the vicinity of the heat applying portion 124*a* decreases. FIG. 17C is a schematic diagram illustrating, in an enlarged manner, the vicinity of the heat applying portion 124*a* illustrated in FIG. 17B. The particles 141 charged with a negative potential receive repulsive force 143 from the heat applying portion 124*a* along the lines of electric force of the electric field 140 formed in the ink.

Figure 17D:
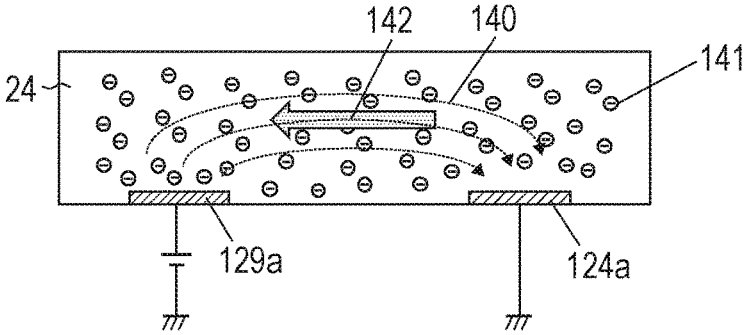
Figure 17E:
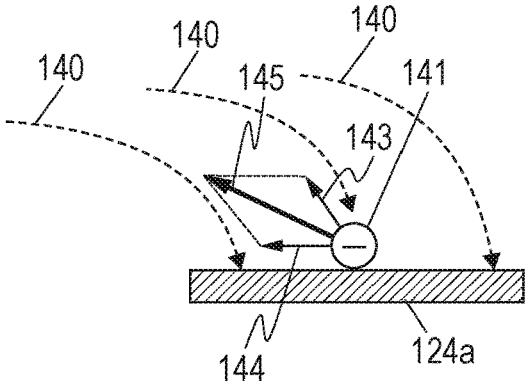

Similar to 17B, FIG. 17D illustrates a state in which a potential is applied to the heat applying portion 124*a* and the electrodes 129*a* and, further, is a state described above in which the ink is flowing from the supply port 17*a* to the collection port 17*b*. In other words, as illustrated by the arrow 142, the ink is flowing in the direction extending from the heat applying portion 124*a* towards the electrode 129*b*. In such a state, the particles 141 charged with a negate potential and that are in the vicinity of the heat applying portion 124*a* not only receive repulsive force 143 from the heat applying portion 124*a* in the state illustrated in FIG. 17B but also receive inertial force 144 directed towards the electrode 129*a* with the flow of the ink. FIG. 17E is a schematic diagram illustrating, in an enlarged manner, the vicinity of the heat applying portion 124*a* illustrated in FIG. 17D. The particles 141 charged with a negative potential move in the direction towards the electrode 129*a* by receiving repulsive force 143 from the heat applying portion 124*a* along the lines of electric force of the electric field 140 formed in the ink and receiving the inertial force 144 generated by the flow of the ink. In other words, the charged particles 141 receive resultant force 145 of the repulsive force 143 and the inertial force 144. Accordingly, in a state in FIG. 17D in which ink is flowing in a direction extending from the heat applying portion 124*a* side towards the electrode 129*a* side, compared with a state in FIG. 17B in which the ink is not flowing, the force directed towards the electrode 129*a* received by the charged particles 141 at the vicinity of the heat applying portion 124*a* is large. With the above, in the state illustrated in rig. 17D, compared with the state illustrated in FIG. 17B, the abundance ratio of the charged particles 141 at the vicinity of the heat applying portion 124*a*, which becomes the cause of the kogation, is small As described above, while distributing the ink, the kogation generation suppressing process is performed by forming an electric field in the ink and repelling the charged particles 141, which become the cause of the kogation, from the heat applying portion 124*a*. It has been known that in so doing, by disposing the electrode 129*a* downstream of the heat applying portions 124*a* of the second protective layer 124 in the ink flowing direction, generation of kogation can be suppressed further.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application. No. 2017-159810 filed Aug. 22, 2017, which is hereby incorporated by reference herein in its entirety.

What is claimed is:

1. A liquid discharge head substrate comprising:

a discharge opening through which a liquid is discharged;

a base that includes a surface in which a heat generating element that generates heat to discharge the liquid through the discharge opening is provided;

a first electrode that covers the heat generating element;

a flow passage through which the liquid flows from a supply port that supplies the liquid, through the surface of the first electrode, and towards a collection port that collects the liquid; and a second electrode provided inside the flow passage, the second electrode together with the first electrode forming an electric field in the liquid, wherein the second electrode is provided downstream of the first electrode in a flow direction of the liquid flowing towards the collection port from the supply port.

2. The liquid discharge head substrate according to claim 1, wherein when viewed in a direction orthogonal to the surface of the base, the first electrode is provided between the supply port and the collection port.

3. The liquid discharge head substrate according to claim 1, wherein when viewed in a direction orthogonal to the surface of the base, the second electrode is provided at a position that is father away from the first electrode with respect to an end portion of the collection port on a first electrode side.

4. The liquid discharge head substrate according to claim 1, wherein when viewed in a direction orthogonal to the surface of the base, the second electrode is provided between the first electrode and the collection port.

5. The liquid discharge head substrate according to claim 1, further comprising:

a heat generating element array in which a plurality of the heat generating elements are arranged, wherein a number of second electrodes is equivalent to or smaller than a number of the heat generating elements included in the heat generating element array.

6. The liquid discharge head substrate according to claim 1, wherein the first electrode and the second electrode are formed of a same material.

7. The liquid discharge head substrate according to claim 1, wherein the liquid discharge head substrate is configured such that during a liquid discharging operation, a voltage is applied between the first electrode and the second electrode so that a charged particle included in the liquid is electrically repelled from the first electrode.

8. The liquid discharge head substrate according to claim 7, wherein the liquid is aqueous ink and the charged particle is a color material.

9. A liquid discharge head comprising:

liquid discharge head substrate including:

a discharge opening through which a liquid is discharged;

a base that includes a surface in which a heat generating element that generates heat to discharge the liquid through the discharge opening is provided;

a first electrode that covers the heat generating element;

a flow passage through which the liquid flows from a supply port that supplies the liquid, through the surface of the first electrode, and towards a collection port that collects the liquid;

a second electrode provided inside the flow passage, the second electrode together with the first electrode forming an electric field in the liquid; and a pressure chamber including the heat generating element therein, wherein the second electrode is provided downstream of the first electrode in a flow direction of the liquid flowing towards the collection port from the supply port, wherein the liquid inside the pressure chamber is circulated external to the pressure chamber.

10. A liquid discharge apparatus comprising:

a liquid discharge head that includes a liquid discharge head substrate;

the liquid discharge head substrate including:

a discharge opening through which a liquid is discharged;

a base that includes a surface in which a heat generating element that generates heat to discharge the liquid through the discharge opening is provided;

a first electrode that covers the heat generating element;

a flow passage through which the liquid flows from a supply port that supplies the liquid, through the surface of the first electrode, and towards a collection port that collects the liquid; and a second electrode provided inside the flow passage, the second electrode together with the first electrode forming an electric field in the liquid, wherein the second electrode is provided downstream of the first electrode in a flow direction of the liquid flowing towards the collection port from the supply port, and a voltage applying member that applies a voltage between the first electrode and the second electrode.

11. A method of controlling a liquid discharge head that includes a discharge opening through which a liquid is discharged, a base that includes a surface in which a heat generating element that generates heat to discharge the liquid through the discharge opening is provided, a first electrode that covers the heat generating element, a flow passage including a supply port that supplies the liquid, and a collection port that collects the liquid, and a second electrode provided inside the flow passage, the method of controlling a liquid discharge head comprising:

providing second electrode downstream of the first electrode in a flow direction of the liquid flowing towards the collection port from the supply port; and applying a voltage between the first electrode and the second electrode so as to electrically repel a charged particle included in the liquid from the first electrode while distributing the liquid through the flow passage from the supply port, through a surface of the first electrode, and towards the collection port.

12. The method of controlling a liquid discharge heat according to claim 11, wherein during a liquid discharging operation, a voltage is applied between the first electrode and the second electrode.

13. The method of controlling a liquid discharge heat according to claim 11, wherein a liquid is distributed from the supply port towards the collection port before the voltage is applied.

14. The method of controlling a liquid discharge heat according to claim 11, wherein when viewed in a direction orthogonal to the surface of the base, the first electrode is provided between the supply port and the collection port.

15. The method of controlling a liquid discharge heat according to claim 11, wherein a voltage is applied between the first electrode and the second electrode so that a current does not flow between the first electrode and the second electrode through the liquid.

16. The method of controlling a liquid discharge heat according to claim 11, wherein a voltage is applied between the first electrode and the second electrode so that a potential of the second electrode is +0.10 V or higher than a potential of the first electrode.

17. The method of controlling a liquid discharge heat according to claim 16, wherein the first electrode and the second electrode are formed so as to include iridium, and wherein a voltage is applied between the first electrode and the second electrode so that a potential of the second electrode is +2.5 V or lower than a potential of the first electrode.

* * * * *